US010532397B2

(12) United States Patent
Calvo Poza et al.

(10) Patent No.: US 10,532,397 B2
(45) Date of Patent: Jan. 14, 2020

(54) METHOD AND SYSTEM FOR PRODUCING SAND MOULDS

(71) Applicant: Lorramendi S. Coop., Vitoria (ES)

(72) Inventors: Francisco Calvo Poza, Votoria (ES); Raul Lopez Lucas, Vitoria (ES); Ignacio Echevarria Castano, Vitoria (ES); Ander Eguidazu Aldaur, Vitoria (ES); Cesar Marco Serrano, Vitoria (ES)

( * ) Notice: Subject to any disclaimer, the term of this patent is extended or adjusted under 35 U.S.C. 154(b) by 679 days.

(21) Appl. No.: 14/910,536

(22) PCT Filed: Aug. 4, 2014

(86) PCT No.: PCT/EP2014/066712
§ 371 (c)(1),
(2) Date: Feb. 5, 2016

(87) PCT Pub. No.: WO2015/018786
PCT Pub. Date: Feb. 12, 2015

(65) Prior Publication Data

US 2016/0184882 A1 Jun. 30, 2016

Related U.S. Application Data

(63) Continuation-in-part of application No. 14/893,238, filed on Nov. 23, 2015, now Pat. No. 10,173,259.

(30) Foreign Application Priority Data

Aug. 6, 2013 (EP) ..... 13382319

(51) Int. Cl.
*B22C 9/02* (2006.01)
*B22C 11/10* (2006.01)
*B22C 11/08* (2006.01)
*B22C 19/00* (2006.01)
*B22C 25/00* (2006.01)

(52) U.S. Cl.
CPC ..... *B22C 9/02* (2013.01); *B22C 11/08* (2013.01); *B22C 11/10* (2013.01); *B22C 19/00* (2013.01); *B22C 25/00* (2013.01)

(58) Field of Classification Search
CPC B22C 9/02; B22C 11/08; B22C 11/10; B22C 19/00; B22C 25/00; B22D 33/005; B22D 47/02
See application file for complete search history.

(56) References Cited

U.S. PATENT DOCUMENTS

2008/0135205 A1* 6/2008 Jezwinski ..... B22C 11/10 164/456

FOREIGN PATENT DOCUMENTS

GB 1419592 A * 12/1975 ..... B22D 33/005

* cited by examiner

*Primary Examiner* — Kevin P Kerns
*Assistant Examiner* — Steven S Ha
(74) *Attorney, Agent, or Firm* — Eugenio J. Torres-Oyola; Victor M. Rodriguez-Reyes; Ferraiuoli LLC

(57) ABSTRACT

The method for the stepwise production and advancing of sand mold parts in a mold-string foundry plant comprising a station (1) for making mold parts, a pouring station (3) and a conveyor (2) for stepwise advancing of mold parts (101-109) from said station (1) for making mold parts towards said pouring station (3), includes the step of double indexing the mold parts using a first, moveable, part (21) of the conveyor. By double indexing the mold string, the time during which pouring into the molds has to be interrupted can be reduced.

19 Claims, 16 Drawing Sheets

METHOD AND SYSTEM FOR PRODUCING SAND MOULDS

TECHNICAL FIELD

The invention is related to the field of metal casting using sand moulds.

STATE OF THE ART

Metal casting is often carried out with sand moulds which are produced in machines that produce sand mould parts which are placed in a string one after the other, and transported to a pouring station where each mould, namely, the space between two subsequent mould parts, is filled with metal. These machines often include core setters to insert cores between the mould parts.

This kind of metal casting is advantageous in that for forming n moulds, instead of using 2×n mould parts, only n+1 mould parts are needed. The shape of the object that is to be formed is determined, basically, by the shape of the rear part of one mould part and the shape of the front part of the following mould part in the string of mould parts.

The mould part producing machines typically comprise a moulding chamber in which the sand is introduced (for example, by blowing or by gravity), typically through a hopper or bell arranged above the moulding chamber. Said chamber is closed by means of two closing elements or plates, such as a front plate and a rear plate, between which the sand is pressed or squeezed to configure the mould part. For example, one of said plates can be a mobile and swivelling front plate arranged allow the exit of the mould part, and the rear plate can be arranged at the opposite end of the chamber and be associated with a compaction piston, which also serves to perform the pushing and corresponding expulsion of the mould part through the front end of the chamber. In this kind of machine, the obtaining of the mould part can start with the introduction of the sand in the moulding chamber. Next, in a compression phase of the moulding cycle, the sand is pressed between the front and rear plate. Then, in what can be called the extraction phase of the moulding cycle, the front plate is opened and tilted to allow the exit of the mould part, by pushing it with the rear plate, thereby expelling the mould part from the moulding chamber and, generally, placing the mould part on some kind of conveyor on which a mould string is formed and indexed towards a pouring station. Mould part making machines of this type are described in, for example, U.S. Pat. Nos. 7,007,738, 6,092,585, EP-A-1219830 and EP-A-2357050. These documents describe vertical mould moulding machines comprising a moulding chamber which is closed by means of a shiftable and swiveling front plate and a rear plate provided at an end of an extraction piston, the sand mould being compacted by the opposing pressure of the two plates. In this way, moulds are obtained cyclically, and expelled from the moulding chamber onto a conveyor, where they are aligned and placed against one another forming a mould string which can be transferred towards the pouring station. Generally, the front and the rear plates are provided with pattern plates, as explained in, for example, U.S. Pat. No. 7,806,161, said pattern plates being selected in accordance with the pattern or shape to be given to the front and rear surfaces of the mould part.

That is, when a mould part is delivered from the machine, for example, by the pushing action of the rear plate, it is delivered to a conveyor, to form part of a mould string or string of mould parts. Generally, each time a new mould part is delivered from the machine, the string of moulds is indexed one step corresponding to the width of a mould part. That is, when a new mould part is delivered from the machine, for example, pushed out of the machine by the pushing action of the rear plate and placed at the end of the mould string, the entire mould string is indexed one step. This is repeated every time a new mould part is produced.

The mould string continues to a pouring station where the moulds are filled. Conventionally, at each moment, only one mould is being filled. Thereby, it is easy to synchronise the production of the mould parts and the filling of the moulds: each time a new mould part has been produced, the mould string is indexed one step, and a new mould (the space between two mould parts) can be filled. Thus, the production of mould parts and the filling of moulds can be performed at the same production rate in terms of units per hour.

Nowadays, the machines for the production of this kind of sand moulds for vertical moulding have become rather sophisticated and allow for the production of mould parts at a relatively high speed. However, the pouring of the metal into the moulds often takes a substantial amount of time. For example, it is often preferred to pour the metal into the moulds in a gentle way, in order to avoid turbulence in the molten metal. Thus, when pouring into only one mould at a time, the pouring step can be a bottleneck and limit the production capacity of the plant.

This problem could be solved or reduced by means of a system as the one suggested in U.S. Pat. No. 4,576,217, wherein the moulds are filled in increments via a plurality of serially arranged and sequentially actuated pouring spouts. However, this approach may require very careful synchronization between the operation of the spouts and the transfer of the moulds. Also, it can often be preferred not to interrupt the pouring process: once the pouring has begun, it can often be preferred to complete the filling of the mould in question before moving the mould.

U.S. Pat. No. 7,806,161 teaches a moulding and casting machine in which instead of indexing the string one step corresponding to one mould part width each time a mould part has been produced, the string is double indexed each time two mould parts have been produced. That is, basically, each time the machine has generated two mould parts, the string is displaced a distance corresponding to two mould part widths. At the pouring station, two moulds are being filled simultaneously. Thus, the time available for filling each mould is substantially equal to the time needed by the machine to produce two mould parts. Thus, the production rate can be enhanced and the bottle neck effect of the pouring station can be avoided or at least reduced. The double indexing is accomplished by pushing the mould string with the rear plate, referred to as lateral squeeze head in U.S. Pat. No. 7,806,161, a distance of two mould part widths in one single stroke. However, this appears to require that the rear plate is displaced differently during different cycles of the process: it appears that the rear plate must operate with a first and shorter stroke when the purpose of the movement only resides in pushing a mould part out of the machine, and with a second and larger stroke when the purpose of the movement is the double indexing of the mould string. This need for two different and alternating types of stroke of the rear plate in the horizontal direction and the need for allowing the rear plate to be displaced so far as to carry out the double indexing of the mould string, require a careful and rather complex design of the machine and its operation, including hardware and software. The stroke of the rear plate will be substantially different in the production cycle in relation to which no displacement of the mould string takes place, compared to the stroke of the rear plate in the production cycle in which the double indexing takes place.

Also EP-B-1326726 claims a method and plant in which some kind of double indexing takes place. The claimed method comprises separately producing and discharging a first mould part without moving the mould string and discharging a second mould part, simultaneous delivery of the first and the second mould part to a conveyer, followed by advancing of the mould string a distance corresponding to the length occupied by two moulds parts, that is, a distance corresponding to two mould part widths. At the pouring station, metal is poured into two moulds simultaneously. It is not clear from claim 1 of EP-B-1326726 how the two mould parts are to be delivered to the conveyor simultaneously, but one would guess that the delivery takes place by pushing the mould parts with the rear plate, in line with what is taught by U.S. Pat. No. 7,806,161. Thus, in this sense, also the solution claimed in EP-B-1326726 appears to require the rear plate to operate with two different stroke lengths, that is, with a shorter stroke when the first mould part is discharged and with a longer stroke when the second mould part is discharged followed by the simultaneous delivery of the two mould parts to the conveyor.

Actually, EP-B-1326726 does not explain how the simultaneous delivery is to be carried out: the specific embodiments disclosed in EP-B-1326726 do not include the claimed feature of the simultaneous delivery of two mould parts to the conveyor, but use a different approach: instead of the claimed approach, the described embodiments correspond to a method in which the mould string is indexed one step at a time. For example, in the embodiment of FIG. 2, a mould part is expelled or discharged from the machine in step "OP.4A" whereafter, in step "OP.4B", the mould string is indexed one step, corresponding to the width of one mould part. In this step, from FIG. 2 it appears that the conveyor moves one step, in-sync with the rear plate. Thereafter, the conveyor appears to return one step in the direction towards the mould making machine ("OP.5"), and thereafter the conveyor is indexed one step forward, indexing the mould string one more step towards the pouring station; this takes place in step "OP.6/1". By means of this repeated one-step indexing, two new moulds are placed in the pouring station and filling of these two moulds can begin, while two further mould parts are produced and placed at the end of the mould string (the first one in step "OP.4" and the following one in step "OP.4A", after which the mould string is indexed again). It appears that this approach might make it possible to produce and discharge the moulds using only one single length of stroke of the rear plate. However, the method involves a disadvantage: in the method of FIG. 2, the pouring has to be interrupted before step "OP.4B" is carried out, and can then not be resumed until step "OP.6/1" has been carried out. That is, the pouring has to be interrupted during the period which comprises the first one-step indexing of the mould string, the return of the conveyor one step towards the mould making machine, and the second one-step indexing of the mould string. For a given mould part production rate, this reduces the time available for pouring metal into the moulds.

DESCRIPTION OF THE INVENTION

A first aspect of the invention relates to a method for the stepwise production and advancing of sand mould parts in a mould-string foundry plant comprising a station for making mould parts (which can include a mould part making machine, such as a mould part making machine known from U.S. Pat. Nos. 7,007,738, 6,092,585, EP-A-1219830 or EP-A-2357050), a pouring station (for pouring matter, such as molten metal, into moulds formed of mould parts produced in the station for making mould parts; the pouring station can be arranged for simultaneous pouring of matter, such as molten metal, into a plurality of moulds, such as moulds each formed by two mould parts, one mould part placed after the other mould part) and a conveyor for stepwise advancing of mould parts from said station for making mould parts towards said pouring station. The conveyor comprises a first part that is movable to displace mould parts from the station for making mould parts towards the pouring station. This first part is generally moveable in a horizontal direction, such as in the longitudinal direction of the system, that is, the direction from the station for making mould parts to the pouring station and vice-versa; however, in many embodiments of the invention there can also be a displacement in the vertical direction, and/or in the transversal direction such as when the moveable part comprises press plates arranged to interact with the lateral side surfaces of the mould parts forming the mould string. The first part of the conveyor can be part of something in line with a walking beam arrangement or similar. The first part can be a part having an upper support surface on which the mould parts are placed and supported so that they travel horizontally when the first part is displaced horizontally. In other embodiments of the invention, the first part comprises means to engage with the lateral surfaces of the mould parts, such as plates or beams that can be pressed against the lateral surfaces of the mould parts by actuators, for example, at both sides of the mould string, so that moving said first part of the conveyor in the direction towards the pouring station implies pulling the mould string in the same direction, whereby the mould string can slide over another part of the conveyor which does not move and which can be constituted by a surface, such as a metal surface, such as a continuous surface or a surface constituted by a plurality of parallel subsurfaces such as top surfaces of a plurality of parallel beams. Other embodiments of the invention may combine both systems, so that the first part of the conveyor includes both means for laterally clamping the mould string or part of it, and at least part of the surface on which the moulds are supported. Moving the surface on which the mould parts are supported when moving the mould parts and mould string towards the pouring station can imply the advantage of reducing friction during movement of the mould parts towards the pouring station.

The method comprises producing a plurality of moulds parts in the station for making mould parts and placing said mould parts on the conveyor in order to form a mould string on the conveyor, and forwarding the mould parts or mould string towards the pouring station using the conveyor. The method comprises the steps of, repetitively and sequentially, (a)—producing a first mould part of a pair of two subsequent mould parts, (b)—placing said mould part on the conveyor, (c)—producing a second mould part of said pair of two subsequent mould parts, (d)—placing also said second mould part on the conveyor;

(e)—optionally producing at least one further mould part and placing said further mould part on the conveyor;

(f)—displacing the mould string a distance corresponding to at least two mould part widths, the mould part width being the width of each mould part in the longitudinal direction of the system, that is, in the direction from the station for making mould parts to the pouring station, that is, in the direction in which the mould string and the mould parts are being indexed, so as to position at least two new moulds to be filled in correspondence with the pouring station, so as to allow for simultaneous pouring into these two moulds at the pouring station.

In some embodiments of the invention, the method is a double index method whereby two mould parts are produced for each displacement of the string of moulds or mould parts, and said displacement corresponds to the widths of two mould parts. However, other embodiments of the invention include the optional step (e), so that more than two mould parts, such as three, four or even more mould parts, are produced for each displacement of the mould string. That is, the mould string can be triple indexed or quadruple indexed, etc., and three, four or more moulds can be filled simultaneously. The choice of number of moulds produced for each indexing/displacement/shifting of the mould string can be selected by the skilled person in accordance with practical considerations, such as the time needed to fill the moulds vs. the time needed for producing a mould part, and the mould part making station's capacity of displacing mould parts towards the mould string, for example, by means of pushing them with a rear plate.

In accordance with this aspect of the invention, step (f) is carried out by displacing said first part of the conveyor, generally in the horizontal direction from the station for making moulds towards the pouring station.

Thereby, a very simple arrangement for double (or triple, quadruple, etc.) indexing of the mould string is obtained, which does not require any complex operation of the rear plate for pushing the mould parts such as to place several mould parts simultaneously on a conveyor, or such as to double index the mould parts by using the pushing action of the rear plate.

The moulds can optionally include cores, and the method can then include the step of setting the cores, that is, placing the cores in the moulds, such as by inserting the cores into the moulds at the beginning of the mould string, where the mould parts are added to the mould string when exiting the mould part making machine.

In some embodiments of the invention, the method comprises the step of, after step (f), retaining the mould string using first retaining means to prevent mould parts from being displaced towards the station for making mould parts during pouring at the pouring station, preferably by applying pressure to lateral surfaces and/or to a top surface of at least one mould part. When pouring matter such as metal into the moulds, the pressure inside the mould tends to increase, and this pressure tends to separate the mould parts of the mould string. This tends to push some of the mould parts back towards the station for making mold parts. In systems like the one of U.S. Pat. No. 7,806,161, this can be prevented by using the squeeze plate or rear plate used for double indexing the mould string, to retain the mould string during at least part of the pouring step. However, in at least some embodiments of the present invention, in which the mould string is displaced by means of the moveable first part of the conveyor, additional retaining means are preferably provided, which can be associated with the first part of the conveyor so that they move with said first part of the conveyor, or which can be substantially independent of said first part of the conveyor, for example, so that they are fixed at a position corresponding, for example, to the position of the rearmost mould part of the mould string after the indexing of the mould string has taken place, to act on said rearmost mould part and thus retain it and the rest of the mould string and preventing mould parts from being displaced back towards the station for making mould parts.

In some embodiments of the invention, the first retaining means are arranged so as not to be horizontally displaced with said first part of the conveyor, and to interact with the mould string at a position between the pouring station and the station for making mould parts. This kind of arrangement of the retaining means can have the advantage of making the retaining means rather independent of the first part of the conveyor. This can simplify the design and/or construction of the system, as the two sub-systems (the first part of the conveyor and the first retaining means) do not have to be pre-designed taking each other into account. For example, commercially available conveyors and retaining means can be used, without any substantial need to adapt them to each other. The first retaining means need not be physically linked to the first part of the conveyor, although in many embodiments of the invention they can still be physically linked to other parts of the conveyor, or to a support structure of the conveyor. In other embodiments of the invention, the retaining means can be physically linked, such as attached to, the pouring station and/or the station for making mould parts.

In other embodiments of the invention, said first retaining means are arranged to be displaced (generally, in the horizontal direction; however, they can also be arranged to be displaced in the vertical direction, for example, with the movement of the first part of the conveyor between an upper and a lower position) together with said first part of the conveyor, and preferably arranged to interact with a rearmost mould part of the mould string to prevent movement of said mould part towards the station for making mould parts. This option can be advantageous, for several reasons. One reason is that the conveyor can be provided integrating the first retaining means, which can sometimes be desired from a logistical point of view. Another advantage of this option is that if the system is designed to deliver mould parts so that they will be positioned at a predetermined position of the first part of the conveyor when supported on said first part of the conveyor, for example, so that the last mould part in the mould string shifted by movement of the first part of the conveyor is always in a predetermined position on said first part of the conveyor, for example, close to a rear portion of said first part of the conveyor, it can be ensured that the first retaining means will always be position to correctly interact with the mould part in question, such as the rearmost mould part of the mould string, independently of the widths of the mould parts being produced. This reduces the work involved with adapting the system to a new kind of mould parts having a mould part width differing from the width of the mould parts previously produced.

In some embodiments of the invention, said first retaining means are arranged to retain the mould string by applying pressure to opposite lateral surfaces of a mould part. This arrangement can often be preferred, and provides for a reliable retention of the mould parts. The first retaining means can, for example, be mounted on arms that are pivotable with respect to a vertical axis, and actuated by corresponding actuation means, so as to selectively grip/retain and release the respective mould parts. However, any other suitable arrangement is within the scope of the invention, such as expanding means. Actuation can be, for example, electric, neumatic or hydraulic.

In some embodiments of the invention, the method comprises the step of retaining mould parts when delivered from the station for making mould parts, using second retaining means arranged to retain a mould part to prevent it from being dragged or pulled back towards the station for making mould parts, when a press plate used for delivering the mould part to the conveyor is returning towards the station for making mould parts (for example, into the moulding chamber), wherein said second retaining means are preferably arranged for retaining said mould part by applying pressure to a top surface of said mould part. This option can be preferred when the first mould part is arranged to apply pressure to the lateral surfaces of the mould part, as it makes it easy to arrange a system in which the first and second retaining means do not physically interfere with each other, so that the first and second retaining means can be substantiality designed without taking each other into account. One of them can operate from above, and the other one from the sides.

In some embodiments of the invention, step (f) is carried out without using any squeeze plate or rear plate (12) of the mould-making station to push the mould string in-sync with movement of said first part of the conveyor in the horizontal direction. This is advantageous as it makes the operation of the mould-making machine simpler: for example, the mould-making machine can be arranged to operate with a constant stroke of the rear plate, without the need for carrying out an extra-long stroke when the mould string is to be double indexed or triple indexed, etc.

In some embodiments of the invention, the station for making mould parts includes a mould part making apparatus comprising a moulding chamber in which mould parts are made by pressing sand between a front plate and a rear plate, said rear plate being horizontally displaceable with a stroke so as to push a finished mould part out of the moulding chamber and onto the conveyor. During steps (a)-(e), the rear squeeze plate is repetitively displaced with the same stroke.

In some embodiments of the invention, the conveyor comprises said first part and a second part, both of said first part and second part being moveable in the vertical direction between an upper position in which the mould parts are in contact with the corresponding part of the conveyor so that said part of the conveyor supports the mould parts, and a lower position in which the mould parts are not supported by the respective part of the conveyor. This kind of conveyor can be advantageous in that it can provide for a very precise displacement of a set of mould parts in the horizontal direction, without any need to move the mould parts in the vertical direction.

In some embodiments of the invention, said first part and second part are coordinated so that while the method is carried out, at least one of said first part and second part are in the upper position, so as to maintain the mould string at a constant height.

In some embodiments of the invention, said second part is in the lower position while said first part is being displaced in step (f), and said second part is preferably in said upper position while said first part is returning towards the station for making mould parts.

Another aspect of the invention relates to a method for the stepwise production and advancing of mould parts in a mould-string foundry plant, said plant comprising a station for making mould parts, a pouring station and a conveyor for stepwise advancing of mould parts from said station for making mould parts towards said pouring station, said conveyor comprising a first part that is movable (generally in a horizontal direction, although it can additionally be displaceable in, for example, the vertical direction) to displace mould parts towards the pouring station. The method comprises producing a plurality of mould parts, preferably one after the other, in the station for making mould parts, and placing said mould parts on the conveyor in order to form a mould string on the conveyor, and forwarding the mould parts or mould string towards the pouring station using the conveyor, said conveyor further being associated with first retaining means and second retaining means. The method includes the steps of, repetitively and sequentially, (i)—producing a mould part, (ii)—placing said mould part on the conveyor in contact with a preceding mould part of a string of moulds parts, (iii)—displacing the string of mould parts a distance corresponding to one mould part width so as to position a first new mould to be filled in correspondence with the pouring station, by displacing the first part of the conveyor in said horizontal direction towards said pouring station, and optionally pushing the mould string with a rear plate of the station for making mould parts;

(iv)—returning said first part of the conveyor towards the station for making mould parts a distance corresponding to one mould part width, while optionally retaining the mould string using said second retaining means;

(v)—once again displacing the string of mould parts a distance corresponding to one mould part width so as to position a second new mould to be filled in correspondence with the pouring station, by once again displacing the first part of the conveyor in said horizontal direction towards said pouring station, preferably without pushing the mould string with said rear plate of the station for making mould parts; (optionally, repeating steps (iv) and (v) to displace the mould string additional steps, that is, for triple indexing, quadruple indexing, etc.)

(vii)—retaining the mould string using said first retaining means or said second retaining means so as to prevent mould parts from being displaced towards the station for making mould parts during pouring into the moulds, and beginning pouring into at least two moulds at the pouring station;

(vi)—producing at least one mould part (for example, one mould part in the case of double indexing and more mould parts if triple, quadruple, etc., indexing is desired) and placing said mould part (directly or after producing additional mould parts, so that preferably a constant stroke of the rear plate can be used also in the case of, for example, triple indexing) on the conveyor in contact with the mould part produced in step (i), and optionally retaining said mould part produced in step (vi) by using said second retaining means.

A further aspect of the invention relates to a system for the stepwise production and filling of sand moulds in a mould-string foundry plant comprising a station for making mould parts including an apparatus for making mould parts, said apparatus comprising a moulding chamber in which mould parts are made by pressing sand between a front plate and a rear plate, said rear plate being horizontally displaceable with a stroke so as to push a finished mould part out of the moulding chamber and onto a conveyor, a pouring station arranged for simultaneous pouring of matter, such as molten metal, into a plurality of moulds (that is, at least two moulds) formed of mould parts produced in the station for making mould parts, and the conveyor, said conveyor being arranged for stepwise advancing of mould parts from said station for making mould parts towards said pouring station, said conveyor comprising a first part that is movable (generally in a horizontal direction; however, in many embodiments of the invention there can also be a displacement in the vertical direction) to displace mould parts from the station for making mould parts towards the pouring station.

The first part of the conveyor is arranged to displace a plurality of mould parts towards the pouring station a distance corresponding to two mould part widths in one single stroke in order to replace, at the pouring station, a plurality of filled moulds with a plurality of moulds to be filled, in one single step, thereby reducing the time during which pouring at the pouring station has to be interrupted.

The rear plate is arranged to operate with a constant stroke, during a plurality of subsequent operating cycles. This simplifies the operation and structure of the mould making apparatus, thereby reducing costs, etc., if compared to the rather complex operation of the rear plate that appears to be needed to operate a system such as the one disclosed by, for example, U.S. Pat. No. 7,806,161. Of course, the stroke may be adapted when it is desired to adapt the system to a different type of mould, but during production of a specific mould type, the stroke can remain unchanged and does not need to be altered between different cycles of the mould part production.

In some embodiments of the system, the conveyor comprises said first part and a second part, both of said first part and second part being moveable in the vertical direction between an upper position in which the mould parts are in contact with the corresponding part of the conveyor so that said part of the conveyor supports the mould parts, and a lower position in which the mould parts are not supported by the respective part of the conveyor.

Another aspect of the invention relates to a system for the stepwise production and filling of sand moulds in a mould-string foundry plant comprising

- a station for making mould parts, said station being arranged for delivering said mould parts to a conveyor;
- a pouring station arranged for simultaneous pouring of matter, such as molten metal, into a plurality of moulds (that is, at least two moulds) formed by mould parts produced in the station for making mould parts, and
- said conveyor, said conveyor being arranged for advancing mould parts from said station for making mould parts towards said pouring station;

The system is arranged to operate according to the any of the methods described above.

BRIEF DESCRIPTION OF THE DRAWINGS

To complete the description and in order to provide for a better understanding of the invention, a set of drawings is provided. Said drawings form an integral part of the description and illustrate embodiments of the invention, which should not be interpreted as restricting the scope of the invention, but just as examples of how the invention can be carried out. The drawings comprise the following figures.

DESCRIPTION OF WAYS OF CARRYING OUT THE INVENTION

Figure 1A:
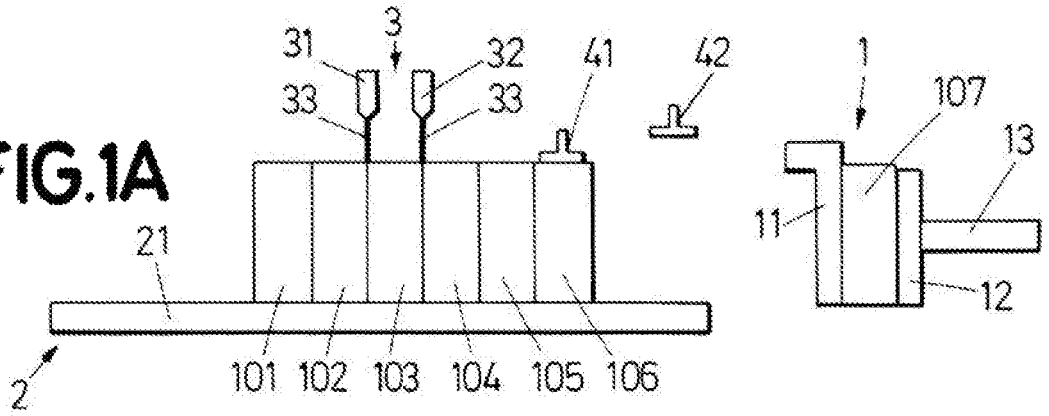
FIG. 1A-1H schematically illustrate a sequence of mould part production and mould string displacement in accordance with an embodiment of the invention.

FIGS. 1A-1H illustrate how the production of mould parts can be synchronised with the pouring of metal and movement of the mould string, in accordance with an embodiment of the invention.

In FIG. 1, a plurality of mould parts 101-106 are placed on a conveyor 2 comprising a first part 21 that is moveable in the horizontal direction to displace the mould string comprising mould parts 101-106 horizontally in the direction from the station for making moulds 1 towards a pouring station 3 comprising two pouring spouts 31 and 32 for filling two moulds, by pouring, for example, molten metal 33 into the moulds. The conveyor system can be of the type comprising a plurality of parallel beams extending in the horizontal direction, some of which form part of the horizontally moveable first part 21 and some of which are part of a second part 22 of the conveyor, shown in FIG. 1B. The first part 21 of the conveyor and the second part 22 of the conveyor are both moveable in the vertical direction, but in this embodiment of the invention, only the first part of the conveyor is moveable in the horizontal direction. Both the first part 21 and the second part 22 are moveable in the vertical direction between an upper position in which the mould parts are in contact with the beams of the respective part of the conveyor so that the beams support the mould parts, and a lower position in which the mould parts are not supported on that part of the conveyor. The first part 21 and the second part 22 are coordinated so that during operation of the system, at least one of said first part 21 and second part 22 are in the upper position. Thus, the mould string is preferably maintained at a constant height during operation, and is not moved up and down.

In FIG. 1A, both the first part 21 and the second part 22 are in the upper position and thus arranged in parallel so that only the first part 21 can be observed in the figure. The beams of the two parts can be placed so that beams of the first part alternate with beams of the second part in the direction orthogonal to the paper in FIG. 1A. This kind of conveyor system is well known in the art and there is thus no need to describe the conveyor system as such more in detail. In FIG. 1A, the beams of the first part 21 and the second part 22 thus alternate in the direction orthogonal to the surface of the paper, and the mould parts 101-106 can be supported both by the first part 21 and the second part 22, that is, by the longitudinally extending beams of said first part 21 and second part 22.

In FIG. 1A, the two spouts 31 and 32 are currently pouring molten metal 33 into the cavities of two moulds, more specifically, the first spout 31 is filling the cavity of the mould defined by mould parts 102 and 103, and the second spout 32 is currently filling the cavity of the mould defined by mould parts 103 and 104. In order to prevent for example mould parts 104-106 from being displaced towards the mould making station, for example, by the pressure created when pouring molten metal into the mould formed by the mould parts 103 and 104, first retaining means 41 are provided to interact with one or more of the mould parts, such as with the rearmost mould part 106 in the mould string, to prevent the mould parts from being displaced towards the station 1 for making mould parts. In FIG. 1A, the first retaining means 41 are schematically illustrated as applied onto the top of the mould part 106, but this is just for illustration purposes, and the retaining means may well interact with the mould part or mould parts in any suitable way, such as by applying pressure to the top surface or to the lateral surfaces of the mould parts, and/or by applying pressure to or gripping behind the rear surface of the mould part or mould parts, such as mould part 106. Thus, the first retaining means 41 serve to prevent movement of the mould parts of the mould string towards the station 1 for making mould parts.

Also, in FIG. 1A, second retaining means are schematically illustrated. These second retaining means 42 can serve to retain a mould part when delivered from the mould making station, to prevent it to be drawn back by the press plate 12 when the press plate returns towards a moulding chamber after delivery of the mould part to the conveyor 2. Also in this case, the second retaining means are only illustrated schematically, and the fact that they appear to apply pressure from above does not mean that this option is necessarily preferred over other options, such as second retaining means 42 that apply pressure to the lateral sides of the mould part. In FIG. 1A, the second retaining means are not activated as no mould part has yet been delivered by the station for making mould parts, after the last indexing of the mould string; that is, no mould part is placed in correspondence with the second retaining means 42.

On the right in the figure station 1 for making mould parts is schematically illustrated. Only the front plate 11 and the rear plate 12 of the mold part making apparatus are shown, as well as the piston 13 driving the rear plate. FIG. 1A shows the moment in which a sand mould part 107 is being formed by pressing sand between the front plate 11 and the rear plate 12. As this kind of machines for making mould parts are well known in the art, there is no need here to describe them more in detail. Any suitable machine can be used, such as, for example, the one known from EP-A-1219830 or the one known from EP-A-2357050, referred to above.

Figure 1B:
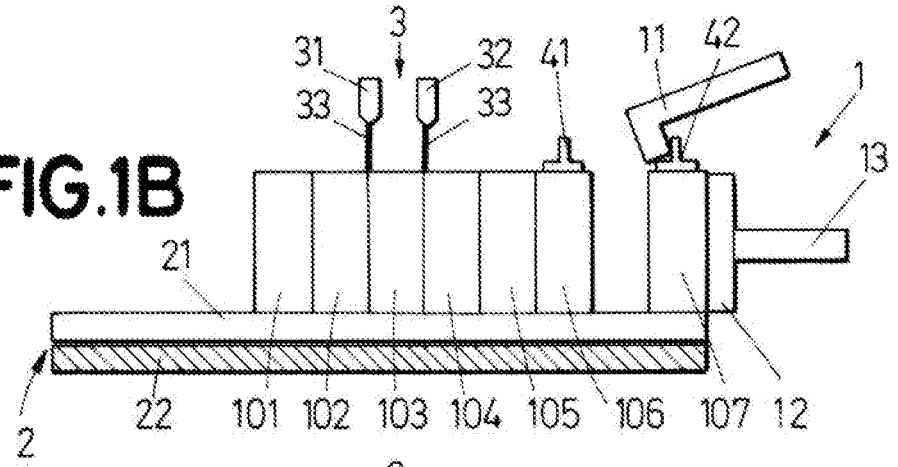

In FIG. 1B, the mould part 107 has been produced and delivered to the conveyor 2 by the pushing action of the rear plate 12. At this stage, the second retaining means are activated and applied to retain this mould part 107, preventing it from being pulled backwards when the second press plate 12 returns into the apparatus for making mould parts. This is illustrated as a downward action of said second retaining means 42, but this is just an option, and other options are likewise valid, such as pressure applied to the sides of the mould part. In FIG. 1B, metal continues to be poured into the two moulds defined by mould parts 102, 103 and 104, and the first retaining means 41 continue to retain the mould string and preventing mould parts from moving towards the station for making mould parts. In FIG. 1B, the second part 22 of the conveyor has been displaced to its lower position, whereby the mould string is only supported by the first part 21 of the conveyor. However, this vertical displacement can likewise take place at a later stage of the process.

Figure 1C:
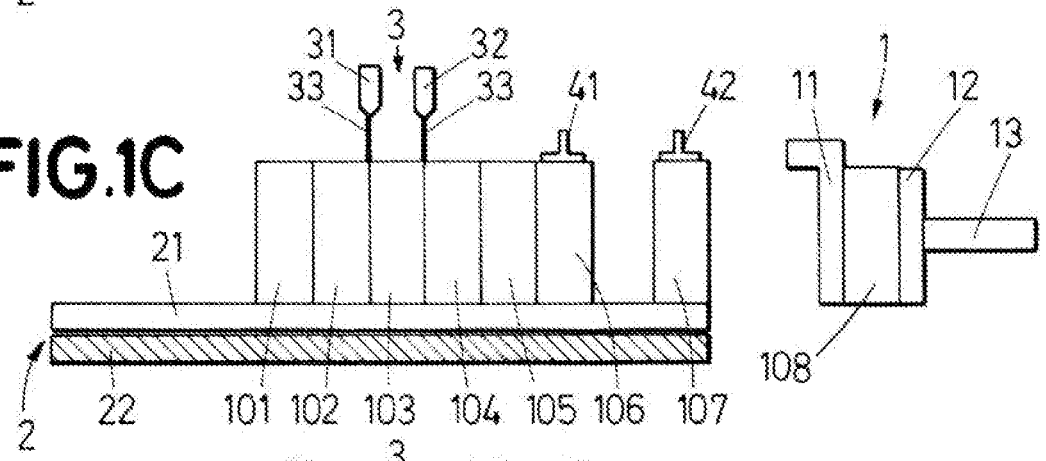

In FIG. 1C, a further mould part 108 is being produced in the station 1 for making mould parts, while molten metal 33 continues to be poured into the moulds at the station for making mould parts.

Figure 1D:
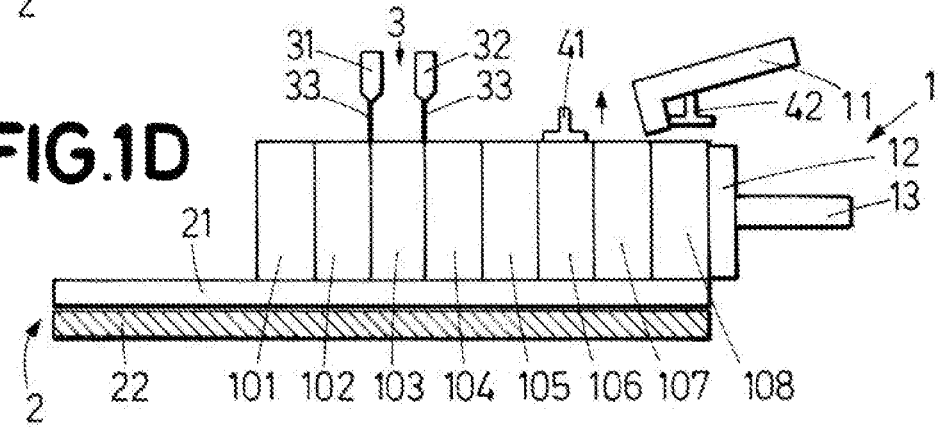

In FIG. 1D, the second mould part 108 of the pair of mould parts made up of mould parts 107 and 108 is delivered to the conveyor 2. Here, the second retaining means 42 have been deactivated so as to allow the previously produced mould part 107 to be indexed on step and to enter into contact with the mould string (namely, with the last mould part 106 of the mould string), and leave room for the recently produced mould part 108. At this stage, pouring of metal into the moulds can have been interrupted, or can be about to be interrupted, and the first retaining means can be about to be deactivated. On the other hand, the second retaining means 42 are about to be activated to prevent the newly produced mould part 108 from being dragged towards the mould making machine when the second press plate 12 returns towards the machine.

Figure 1E:
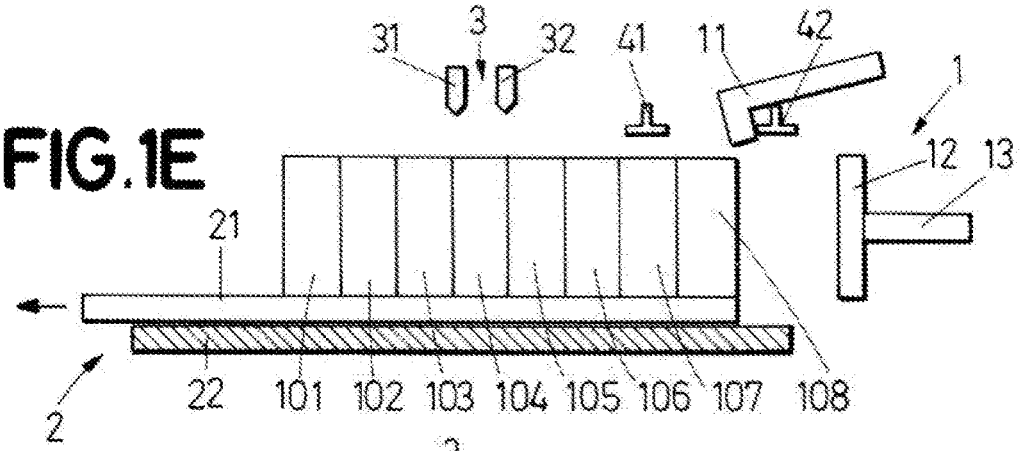
Figure 1F:
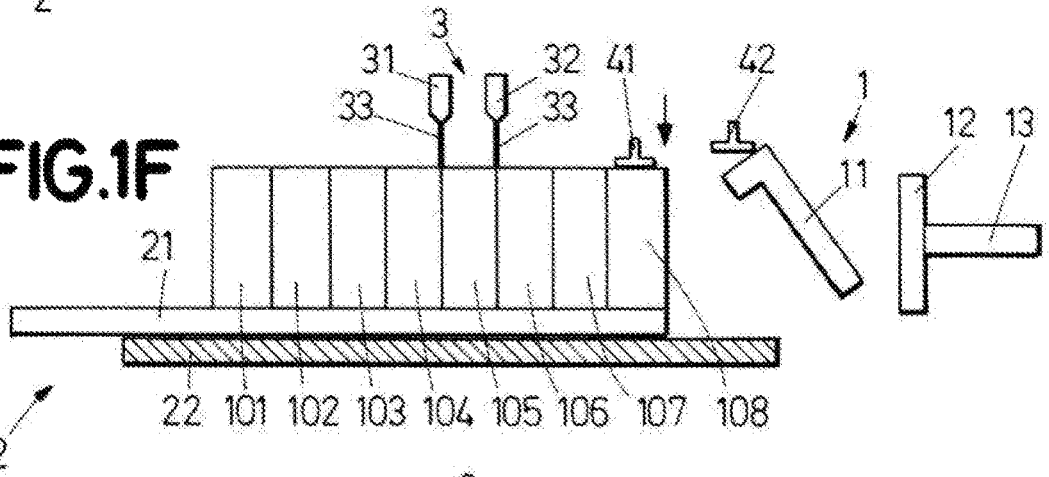
Figure 1G:
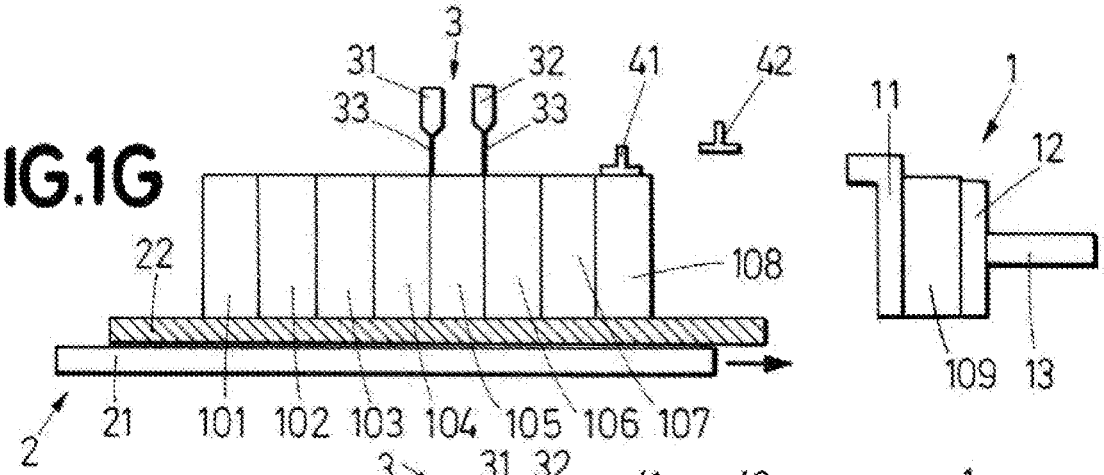
Figure 1H:
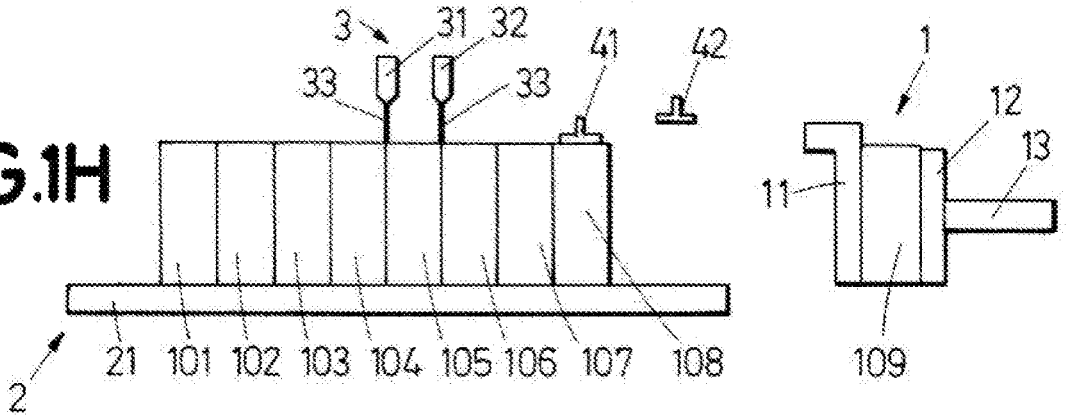

In FIG. 1E, pouring has been interrupted at the pouring station 3, the first retaining means 41 and the second retaining means 42 have been deactivated, and the second part of the conveyor is being displaced horizontally, so as to displace the mould string in the direction from the station for making mould parts to the pouring station. In FIG. 1E the first part 21 of the conveyor has been displaced the distance corresponding to the width of one mould part, and the movement continues until the position illustrated in FIG. 1F, where the first part of the conveyor 21 has been displaced a distance corresponding to the width of two mould parts. In this position, the first retaining means 41 can be activated again, and the pouring of metal 33 can begin again, this time into the moulds defined by mould parts 104, 105 and 106, as illustrated in FIG. 1E. Next, the second part 22 of the conveyor can return to its upper position and thereafter the first part of the conveyor can be displaced to its lower position, whereafter the second part 22 of the conveyor can return towards the station 1 for making mould parts, as illustrated in FIG. 1G, and return to its upper position, as shown in FIG. 1H. Here, the system is in the same state as in FIG. 1A, with simultaneous pouring into two moulds taking place while a new mould part 109 is being produced.

The advantages of this system are self-evident: it provides for a flexible approach allowing for multiple indexing (such as double, triple, quadruple, etc.) without requiring any special pushing action by the rear plate, apart from the pushing action that the rear plate conventionally performs for delivering mould parts to a conveyor, and pouring can take place uninterruptedly during the entire cycle, except for the time needed for indexing the mould string two steps or more.

In the embodiment of FIGS. 1A-1H, the first retaining means 41 are not associated with the first part 21 of the conveyor, but remain in a fixed position in relation to the pouring station. This approach can sometimes be practical, as it can render the implementation of the first retaining means 41 independent of the design of the conveyor, which can contribute to increased flexibility. However, it may require additional adjustments when there is a change in the width of the mould parts, that is, when production is commenced of mould parts having a width differing from the width of the previously produced mould parts. In such cases, in addition to the adjustment of the displacement or stroke of the first part of the conveyor, also the position of the retaining means may sometimes need adaptation.

Figure 2A:
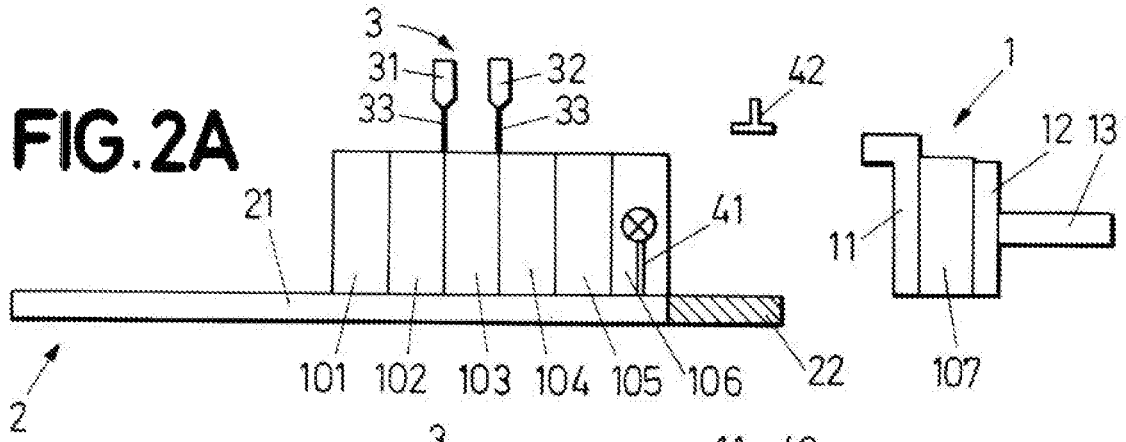
FIG. 2A-2H schematically illustrate a sequence of mould part production and mould string displacement in accordance with another embodiment of the invention.

FIGS. 2A-2H schematically illustrate another embodiment of the invention, in which this potential drawback is overcome by integrating the first retaining means with the first part 21 of the conveyor. In FIG. 2A it can be observed how the first part 21 and the second part 22 of the conveyor are both placed in their upper position, so that the mould parts 101-106 rest on both parts 21 and 22 of the conveyor, while molten metal 33 is being poured into the moulds defined by mould parts 102 and 103, and by mould parts 103 and 104, respectively. In this embodiment of the invention, the mould parts are prevented from moving back towards the station 1 for making mould parts by the first retaining means 41, which are associated with the first part 21 of the conveyor. In FIG. 2A, the first retaining means are schematically illustrated as retaining the rearmost mould part 106 of the mould string by applying pressure to the sides of said mould part 106, but any other suitable retaining means are within the scope of the invention, for example, retaining means applying pressure from above.

Figure 2B:
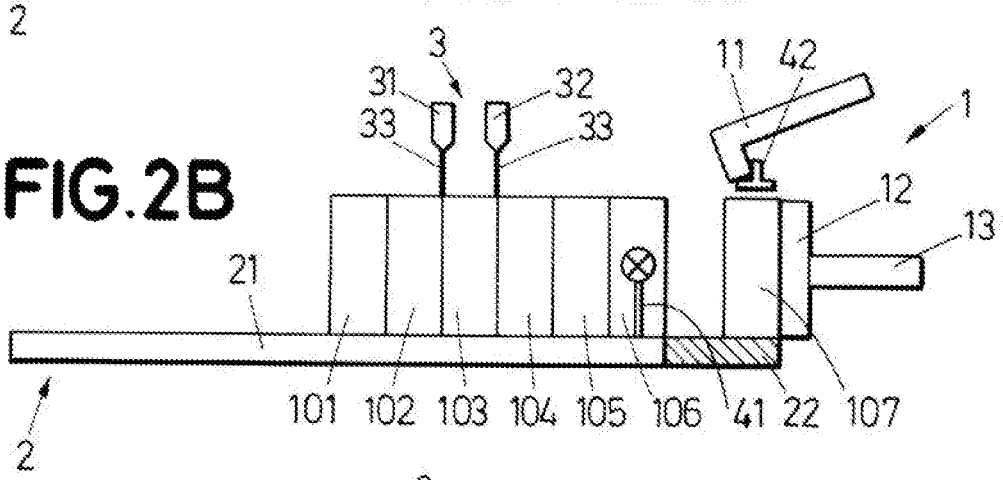
Figure 2C:
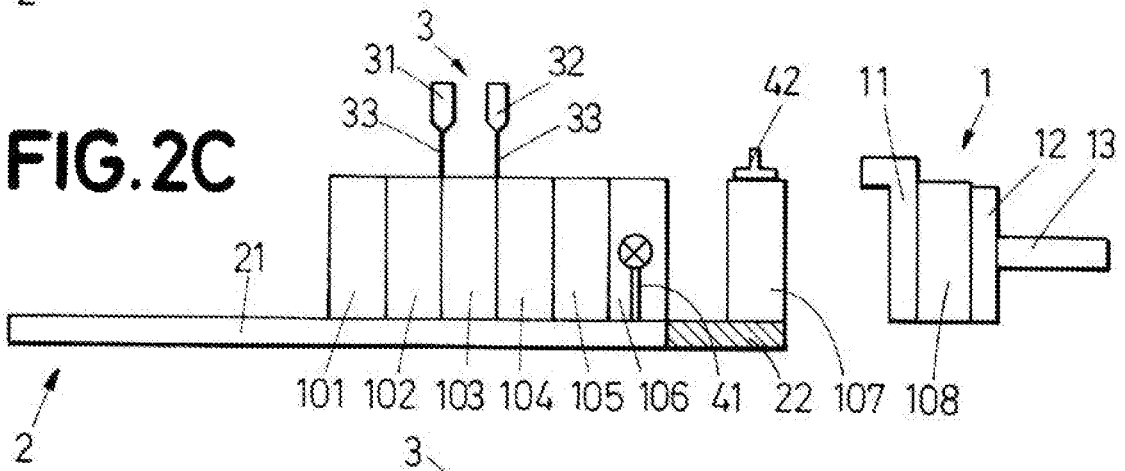

In FIG. 2B, the rear plate 12 has pushed a newly produced mould part 107 out of the machine and delivered it to the conveyor 2, by placing it on the rearmost portion of the second part 22 of the conveyor, and in FIG. 2C the rear plate 12 has returned while the newly delivered mould part 107 is retained on the conveyor 2 by the second retaining means 42.

Figure 2D:
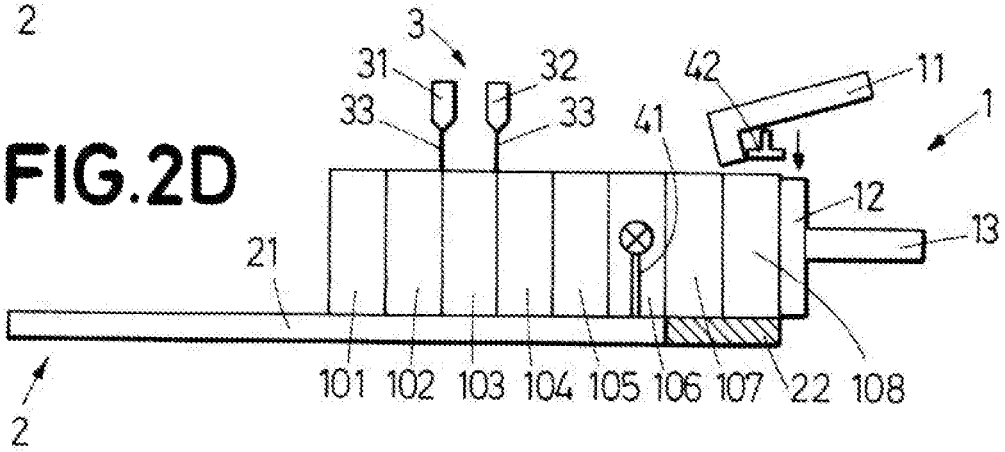

In FIG. 2D the station 1 for making mould parts has delivered a further mould part 108 to the conveyor 2, by placing it on the second part of the conveyor, pushing the previously produced mould part 107 one step towards the mould string made up of the mould parts 101-106, so that it makes contact with said mould string. Subsequently, the second retaining means 42 are activated to retain the mould part 108 in its position.

Figure 2E:
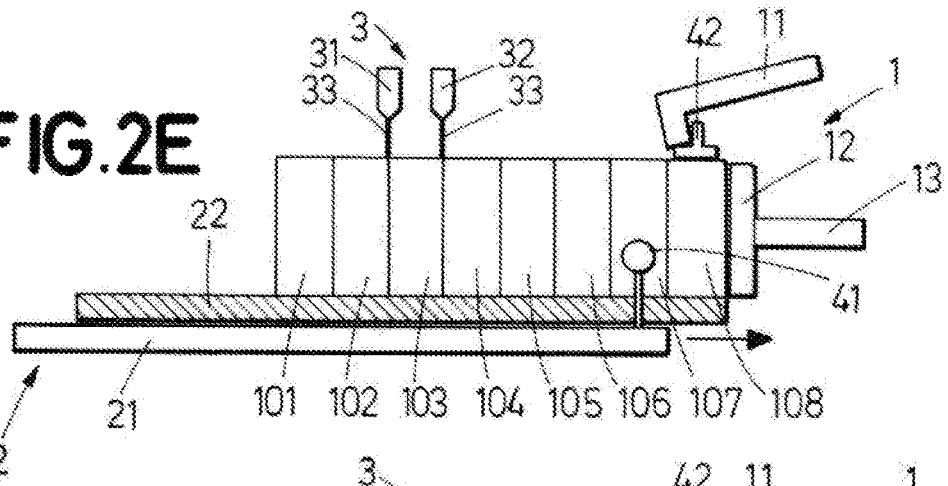
Figure 2F:
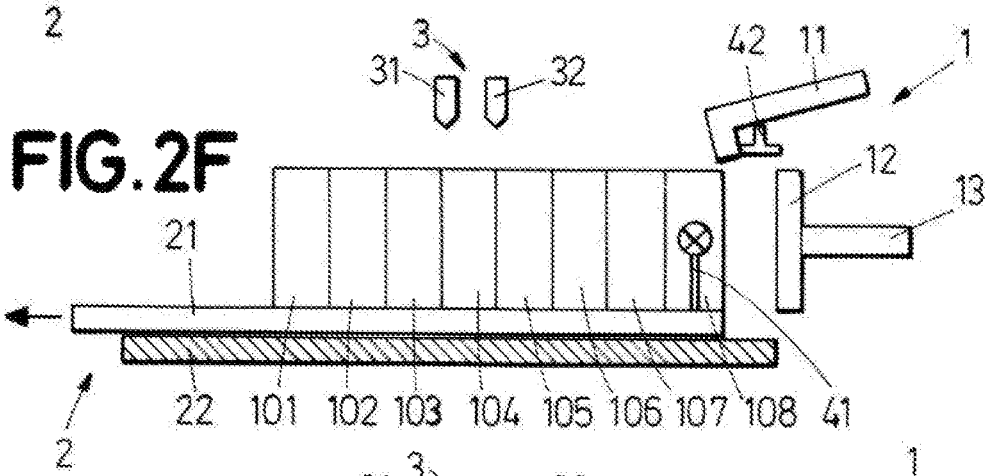

Thereafter, as illustrated in FIG. 2E, the first retaining means are deactivated so as to release the mould string; at this stage, the second retaining means 42, interacting with the latest produced mould part 108, prevent the mould parts from being displaced towards the mould part making machine. Next, the first portion 21 of the conveyor is lowered and displaced towards the station 1 for making mould parts, as schematically illustrated in FIG. 2E. This displacement amounts to a distance corresponding to the width of two mould parts. After this displacement, the first part 21 of the conveyor returns to its upper position so as to support the mould string including mould parts 107 and 108, whereas the second part 22 of the conveyor is lowered, so as to allow shifting of the mould string in the direction towards the pouring station 2, as schematically illustrated in FIG. 2F, by displacement of the first part 21 of the conveyor; during this displacement, pouring is interrupted at the pouring station.

Figure 2G:
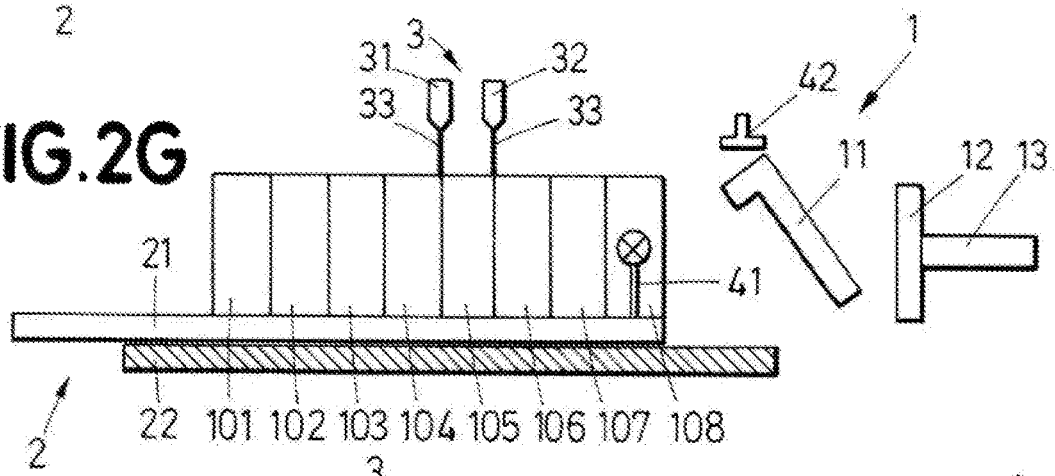
Figure 2H:
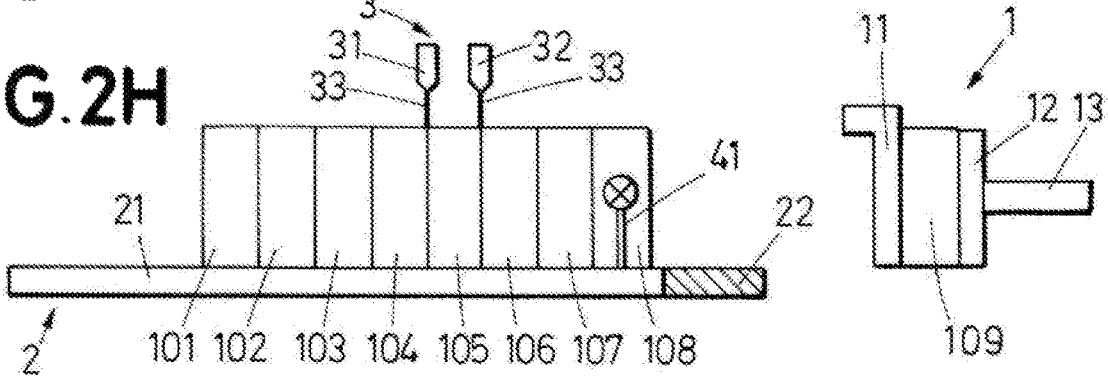

In FIG. 2G, the displacement of the first part 21 of the conveyor has concluded, and this first part 21 of the conveyor and the mould string have been displaced in the direction from the station 1 for making mould parts towards the pouring station, a distance corresponding to twice the width of a mould part, that is, the mould string has been double indexed, and pouring at the pouring station can begin again, this time into the moulds defined by mould parts 104-106. Also in this embodiment of the invention, pouring only has to be interrupted during the displacement of the mould string, that is, during the displacement of the first part 21 of the conveyor.

Both of these embodiments are advantageous in that they minimize the time during which pouring has to be interrupted, while allowing for filling of more than one mould at a time, and while allowing for completing the filling of the moulds prior to indexing the mould string. These embodiments are also advantageous in that they achieve this objective without requiring any special adaptation of the mould making machine, especially, without requiring any special adaptation of the stroke of the rear plate, as the rear plate is not needed to displace the mould string, but just used to position the newly produced moulds on the conveyor. In these embodiments, each newly produced mould is positioned on the conveyor in substantially the same position, so that the mould making machine can be operated with a constant stroke of the rear plate. The embodiments of FIGS. 1A-1H are advantageous in that the first retaining means are not associated with the first part 21 of the conveyor, which sometimes can be advantageous from a constructional point of view or in what regards logistics in relation to machine components, whereas the embodiment of FIGS. 2A-2H have the first retaining means associated with the first part of the conveyor so that they move with the first part of the conveyor, so that they can be arranged to always interact with, for example, the rearmost mould part of the mould string without requiring any adaptation when there is a change in the width of the mould parts to be produced. That is, as the first retaining means 41 move with the first part 21 of the conveyor, they can be placed to interact with mould parts in a position close to the rear portion of the first part of the conveyor 21, that is, in a position that will always be occupied by the rearmost mould part of the mould string, such as mould part 106 in FIGS. 2A-2D or mould part 108 in FIGS. 2F to 2G. This can serve to facilitate adaptation of a system to different mould widths.

Figure 3A:
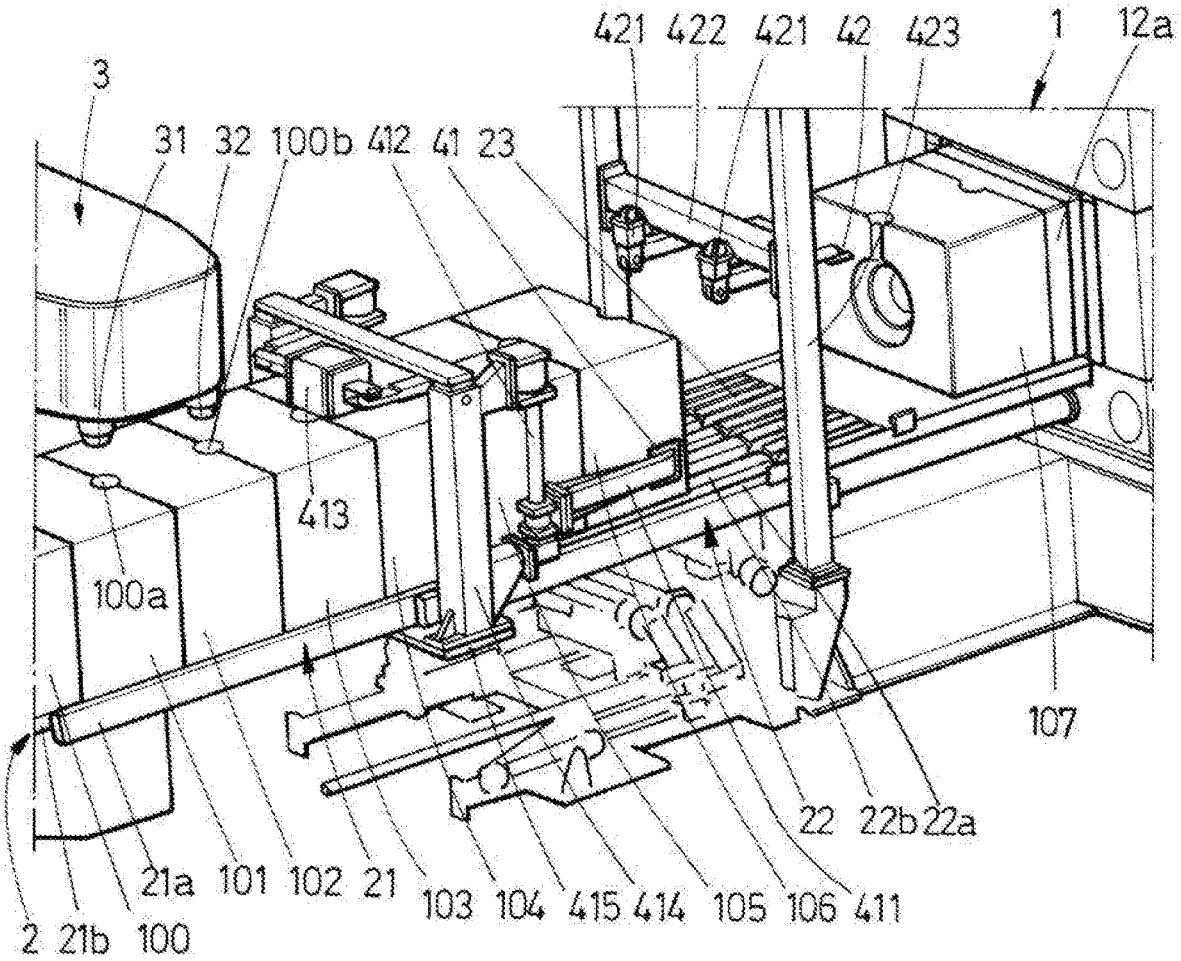
FIGS. 3A-3F illustrate some details of a system or installation operating according to the principles of the embodiment illustrated in FIGS. 2A-2H.

FIGS. 3A-3F illustrate with more detail a system operating in line with some of the principles of the method of FIGS. 2A-2H. In FIG. 3A, it can be observed how a string of mould parts 100-106 has just been double indexed so that two new moulds to be filled have been placed under corresponding spouts 31 and 32 of a pouring station, in order to start simultaneous filling of the moulds defined by mould parts 101 and 102, and 102 and 103, respectively, by pouring the metal into the holes 100*a* and 100*b* formed between the mould parts 101 and 102 and between the mould parts 102 and 103, respectively.

The mould parts 100-106 have been displaced a distance corresponding to two mould part widths, that is, the mould string has been double indexed, so as to place the two new moulds under the spouts. Two recently filled moulds, a rear one of which is formed between mould parts 100 and 101, have been shifted away from the pouring station in the same step of double indexing, towards a station (not shown) for extracting the moulded objects from the moulds.

The mould parts have been shifted by horizontally displacing the first part 21 of the conveyor 2, which comprises a plurality of beams 21*a*, 21*b*, arranged in parallel and interlaced with beams 22*a*, 22*b* of the second part 22 of the conveyor. The first part 21 of the conveyor and the second part 22 of the conveyor are both displaceable in the vertical direction, so that the second part 22 of the conveyor can be displaced to a lower position so as not to interfere with the mould parts when shifted away from the station 1 for making mould parts by horizontal displacement of the first part 21 of the conveyor.

In the illustrated embodiment, there is also a third part 23 of the conveyor, which can be substantially fixed in its vertical position, for example, as part of an output section of a mould making machine. Thus, the conveyor 2 can be made up of the first part 21, the second part 22 and the third part 23, the second part 22 being arranged to be lowered when the double indexing of the first part 21 for shifting of the mould parts is to take place, to avoid friction between the mould parts 104-106 and the beams of the second part 22 of the conveyor.

First retaining means 41 are provided to apply pressure to the rearmost mould part 106 of the mould string. These first retaining means are arranged on pivotally arranged arms 411 than can pivot by rotation of vertical bars or shafts 412 actuated by an actuator 413. These shafts 412 and the actuator 413 are arranged in a frame structure 414, 415 connected to the first part 21 of the conveyor, so that the entire arrangement including the first retaining means moves horizontally with the first part 21 of the conveyor. In the position illustrated in FIG. 3A, the first retaining means 41 are applying pressure to lateral surfaces of the rearmost mould part 106, thus preventing the mould parts 103-106 from being displaced rearwards, that is, towards the station 1 for making mould parts, for example, when pressure is built up inside the moulds during pouring of metal into the moulds.

On the other hand, second retaining means 42 are provided on a crossbeam 421 extending between two columns 423 associated with the mould part making machine of the station 1 for making mould parts, and these second retaining means are pivotally arranged on said crossbeam so as to be activated and deactivated by respective actuators 421 arranged to pivot said second retaining means so that they, when they are activated, apply pressure on a top surface of the last mould part delivered from the mould part making machine onto the conveyor 2. The second retaining means 42 can be part of the mould part making machine and arranged to apply the pressure onto the top surface of the mould part placed on the third part 23 of the conveyor, so as to prevent said mould part from being pulled rearwards when the rear plate 12 (shown in FIG. 3B) returns into the moulding chamber after delivering a mould part to the conveyor 2.

In FIGS. 3A-3F, the front plate is not illustrated, for simplicity.

As indicated above, FIG. 3A illustrates the system immediately after a double indexing of the mould string, whereby two new moulds to be filled have been placed under the respective spouts 31, 32. On the other hand, a most recently made mould part 107 is just coming out of the mould part making machine. The first retaining means 41 are activated, thus retaining the mould string and preventing rearward movement of the mould parts by firmly clamping the rearmost mould part 106 of the mould string, and the second retaining means are deactivated so as not to interact with the recently produced mould part 107 when delivered. In FIG. 3A, the pattern plate 12*a* associated with the rear plate 12 can be observed, just coming out of the moulding chamber of the mould part making machine.

Figure 3B:
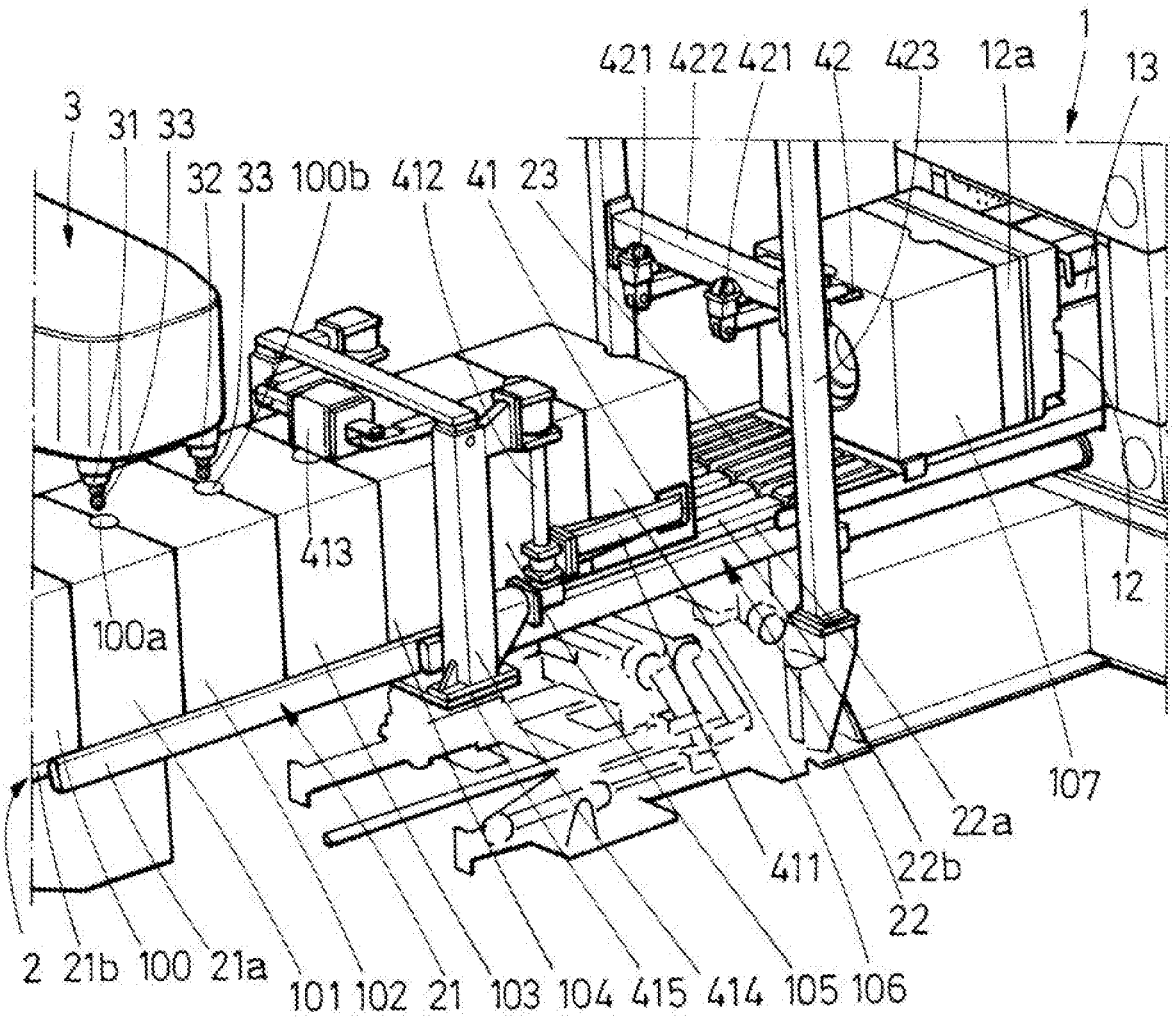

FIG. 3B illustrates the state of the system immediately after the state shown in FIG. 3A, that is, immediately after the double indexing of the mould string by the horizontal shifting of the first part 21 of the conveyor. In FIG. 3B, molten metal 33 is just beginning to pour into the moulds defined by mould parts 101-103. The mold string is being retained at its rear end by the first retaining means 41. At the station 1 for making mould parts, the latest produced mould part is being pushed out of the machine by the stroke of the rear plate 12 actuated by the piston 13, in the way in which extraction of mould parts is conventionally carried out in this kind of machines.

Figure 3C:
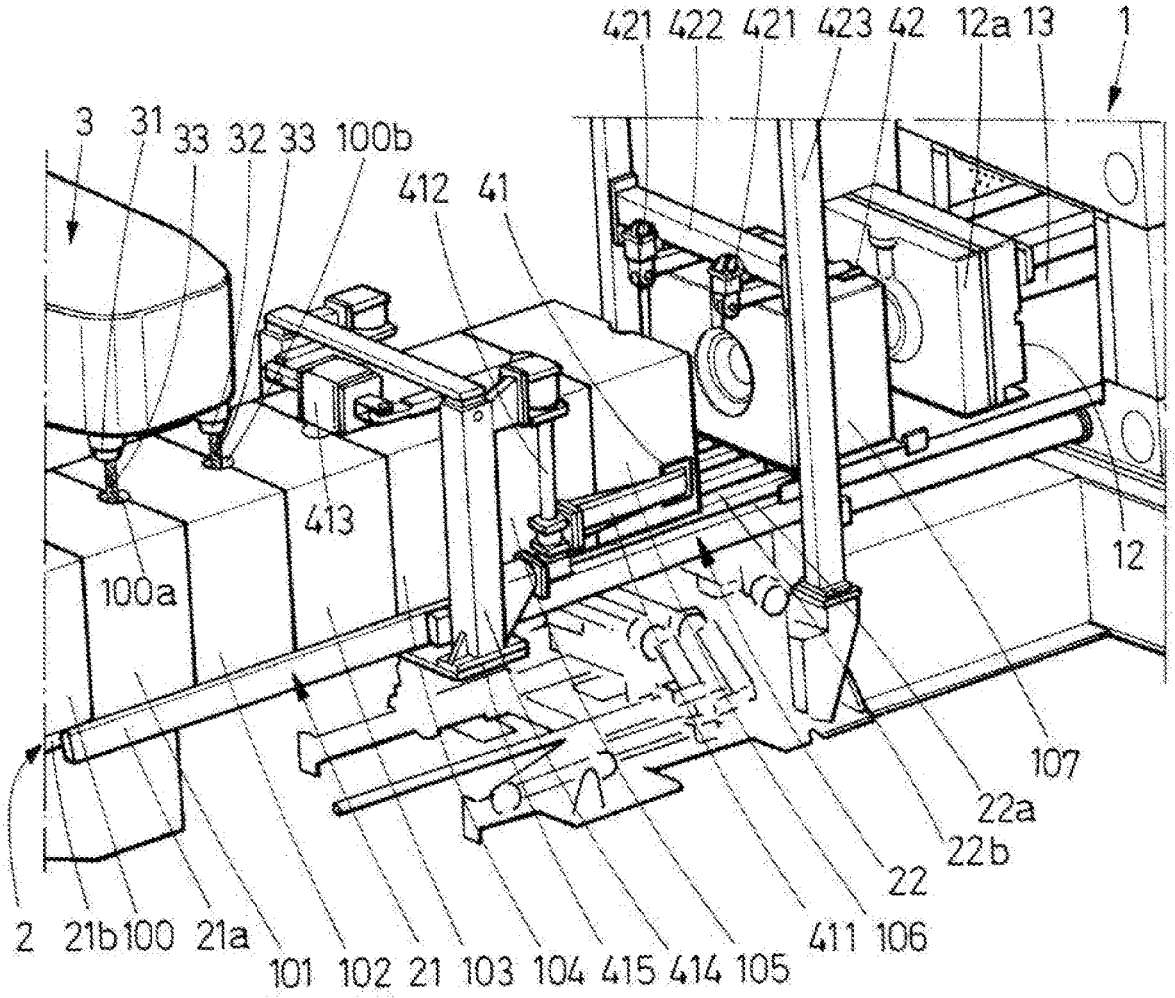

In FIG. 3C and while metal 33 continues to pour into the moulds at the pouring station 3, the mould part 107 has been delivered to the conveyor and the second retaining means 42 have been activated to apply pressure onto the top surface of the mould part 107, thus preventing it from being pulled rearwards by the rear plate 12 when the rear plate 12 with its pattern plate 12*a* is returning into the moulding chamber of the machine, for carrying out a new cycle of mould part production. Thus, the second retaining means are retaining the recently produced mould part 107 on the third part 23 of the conveyor.

Figure 3D:
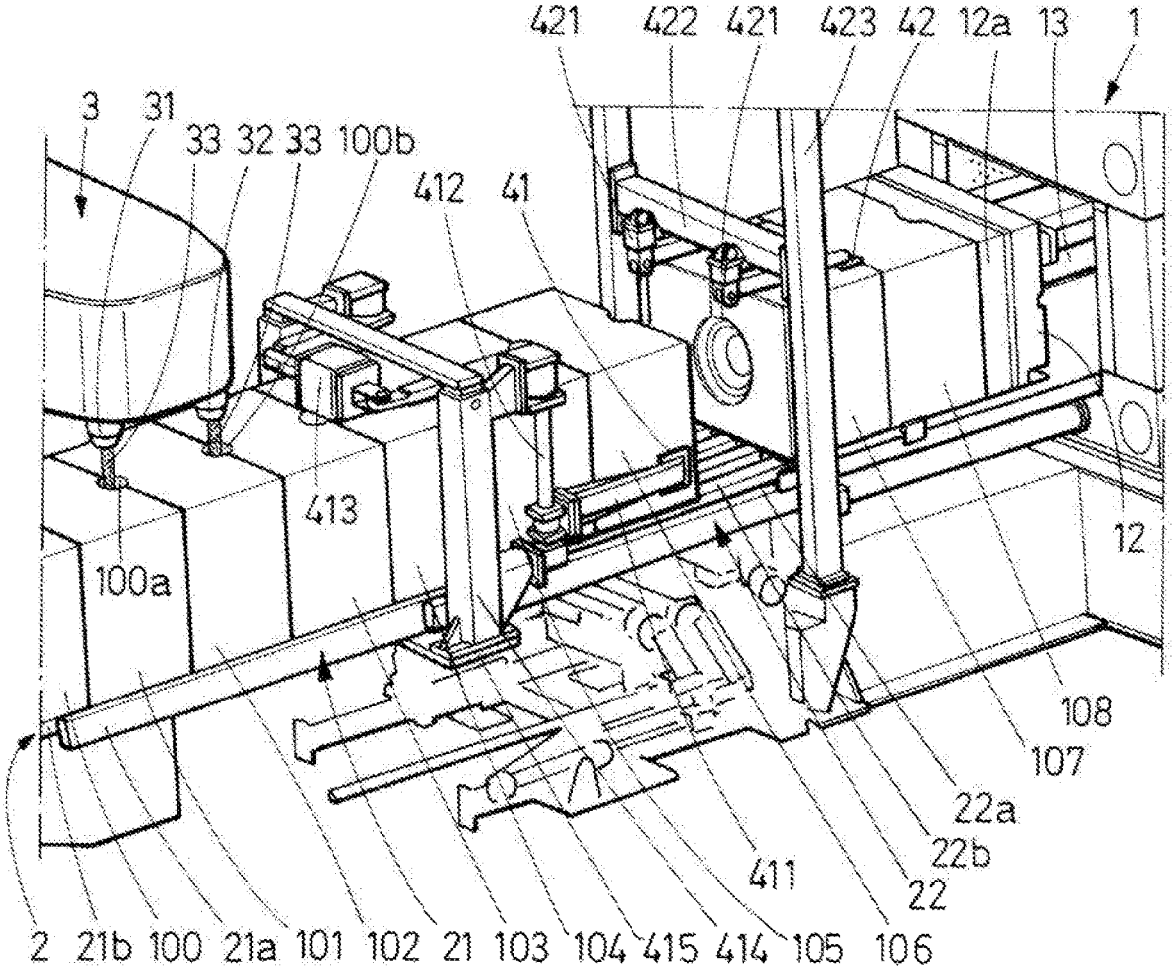
Figure 3E:
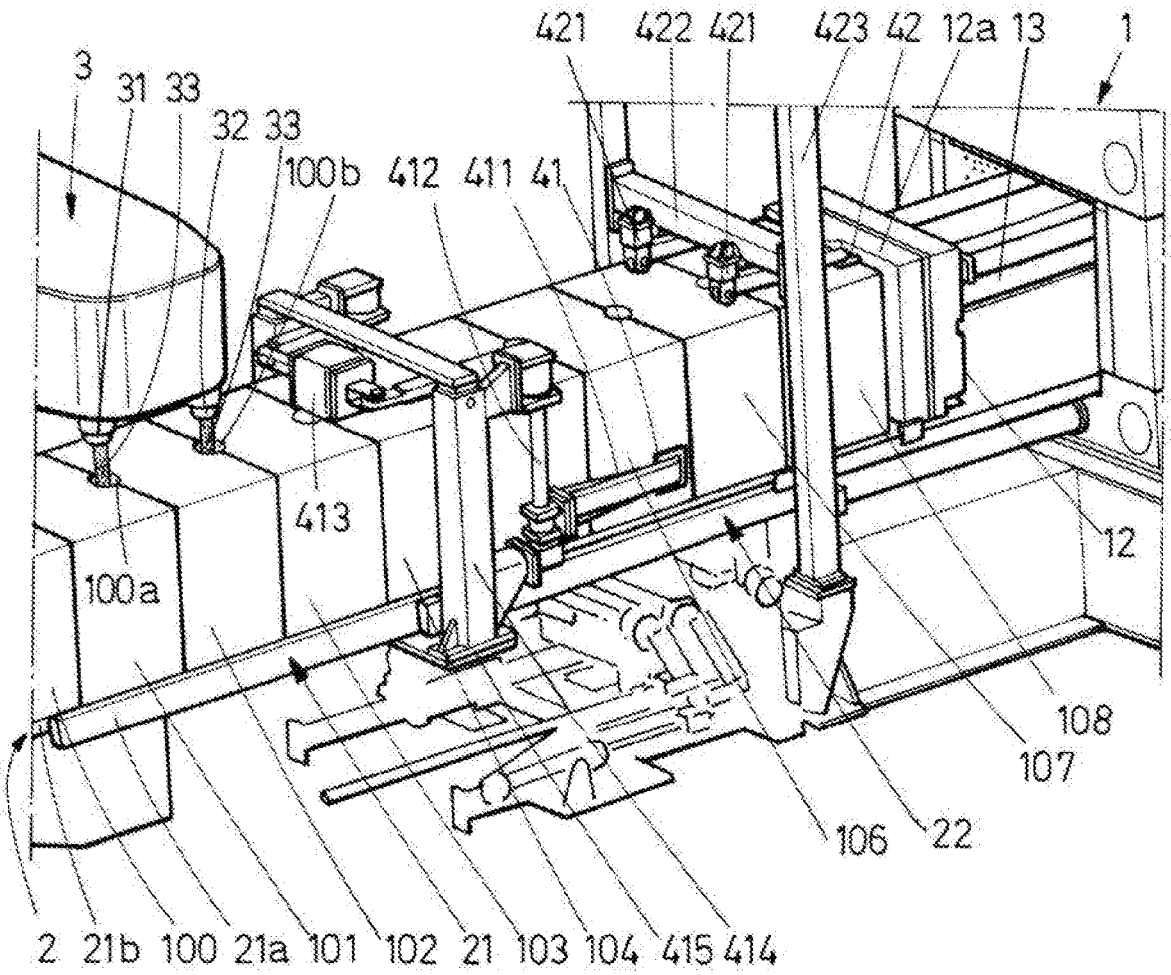

In FIG. 3D, a new mould part 108 is being pushed out of the moulding chamber of the mould part making machine, arriving at the previously produced mould part 107 which is under the second retaining means. At this moment, the second retaining means 42 have been or are deactivated so as to allow the previously produced mould part 107 to be pushed forwards by the action of the rear plate 12, until the position shown in FIG. 3E, where the latest produced mould part 108 has occupied the position on the third part 23 of the conveyor previously occupied by the previously produced mould part 107, which has in turn been pushed onto the second part 22 of the conveyor until making contact with the rearmost mould part 106 of the mould string. At this stage, the second retaining means 42 are activated again so as to apply pressure onto the top surface of the rearmost mould part 108. At this stage, the second retaining means actually retain the entire mould string, as mould parts 100-106 are all in contact.

Figure 3F:
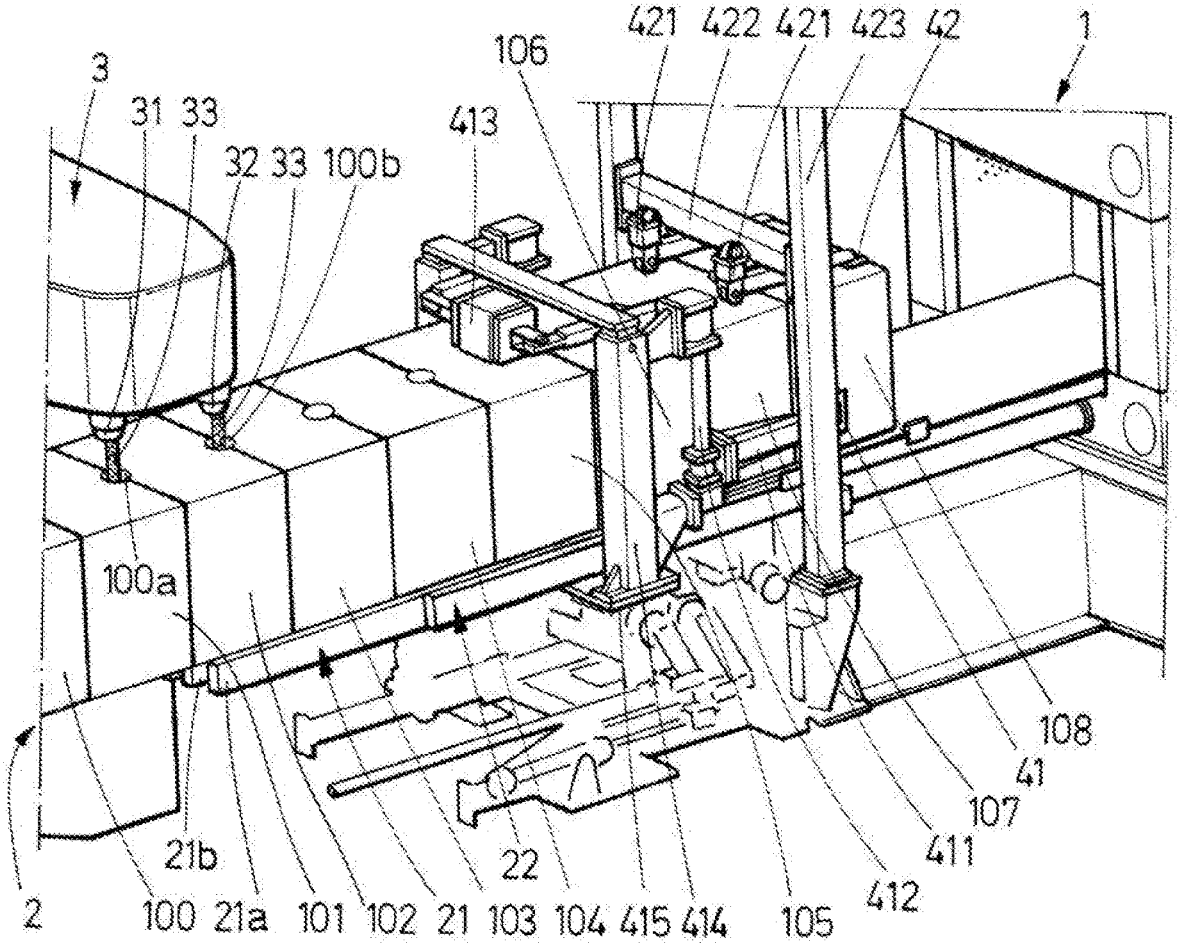

At this stage, the first retaining means 41 can be released/deactivated so as to cease to apply pressure onto the lateral surfaces of the mould part, by pivoting the arms 411 outwards (only one of said arms being shown in FIG. 3E, the other one being on the other side of the mould string), whereafter the first part 21 of the conveyor can be lowered and subsequently displaced two mould widths in the horizontal direction, in the direction towards the station 1 for making mould parts, until the position shown in FIG. 3F, where the first part 21 of the conveyor can return to its upper position, engage the mould string by applying pressure onto the lateral surfaces of the rearmost mould part 108 and, after lowering of the second part 22 of the conveyor and stopping of the pouring at the pouring station 3, the mould string can be double indexed by displacing the first part 21 of the conveyor horizontally, a distance corresponding to the width of two mould parts, thereby placing two new moulds, defined by mould parts 103-105, under the spouts 31 and 32 of the pouring station 3, thereby returning to the state of the system shown in FIG. 3A.

An alternative embodiment is illustrated in FIGS. 4A-4F. The components of the system are the same as those already described with reference to FIGS. 3A-3F, but the system is arranged to operate in accordance with a different sequence, basically, using two strokes of the first part 21 of the conveyor for completing the double indexing.

Figure 4A:
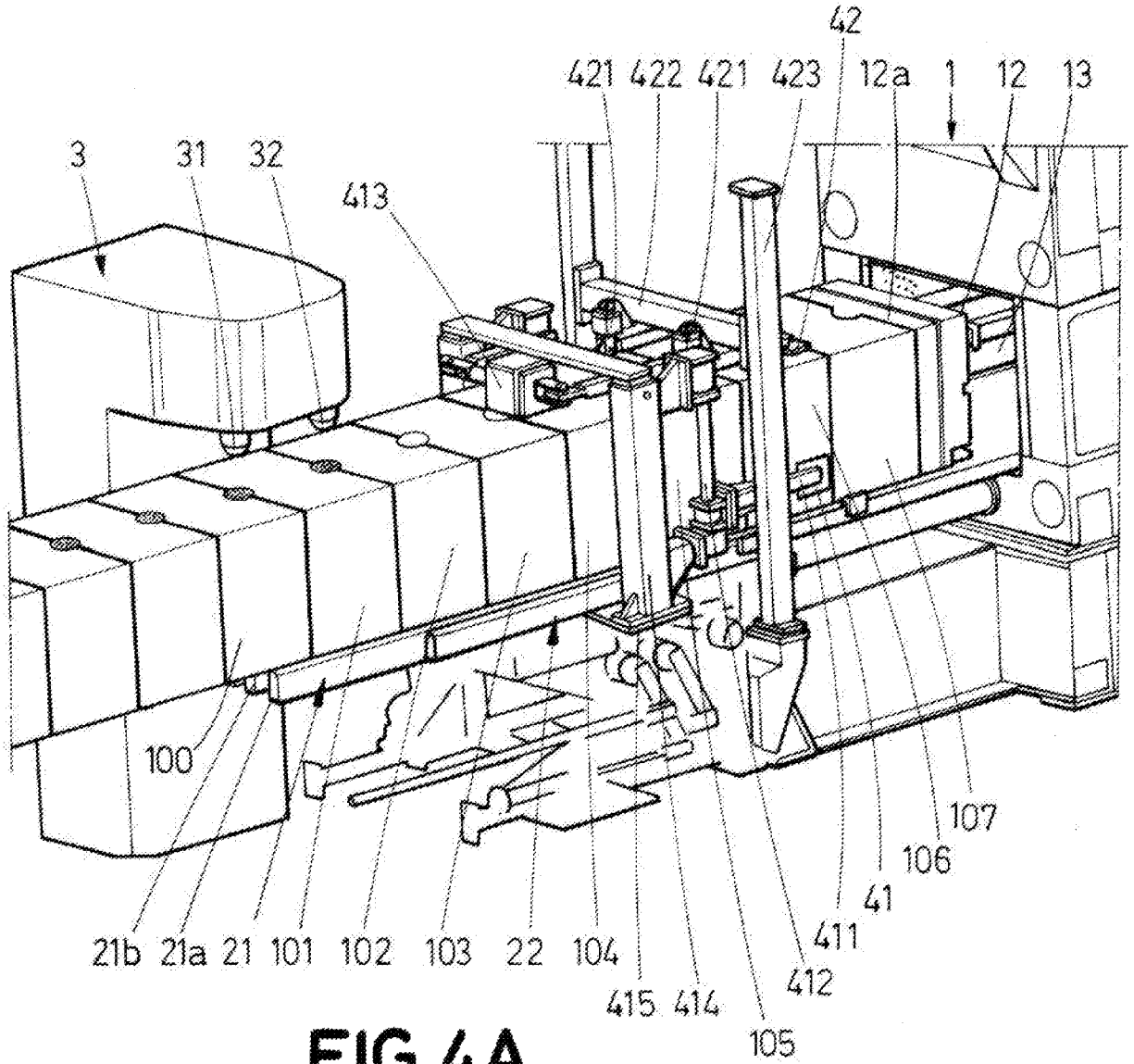
FIGS. 4A-4F illustrate some details of a system or installation operating according to another embodiment of the invention.
Figure 4B:
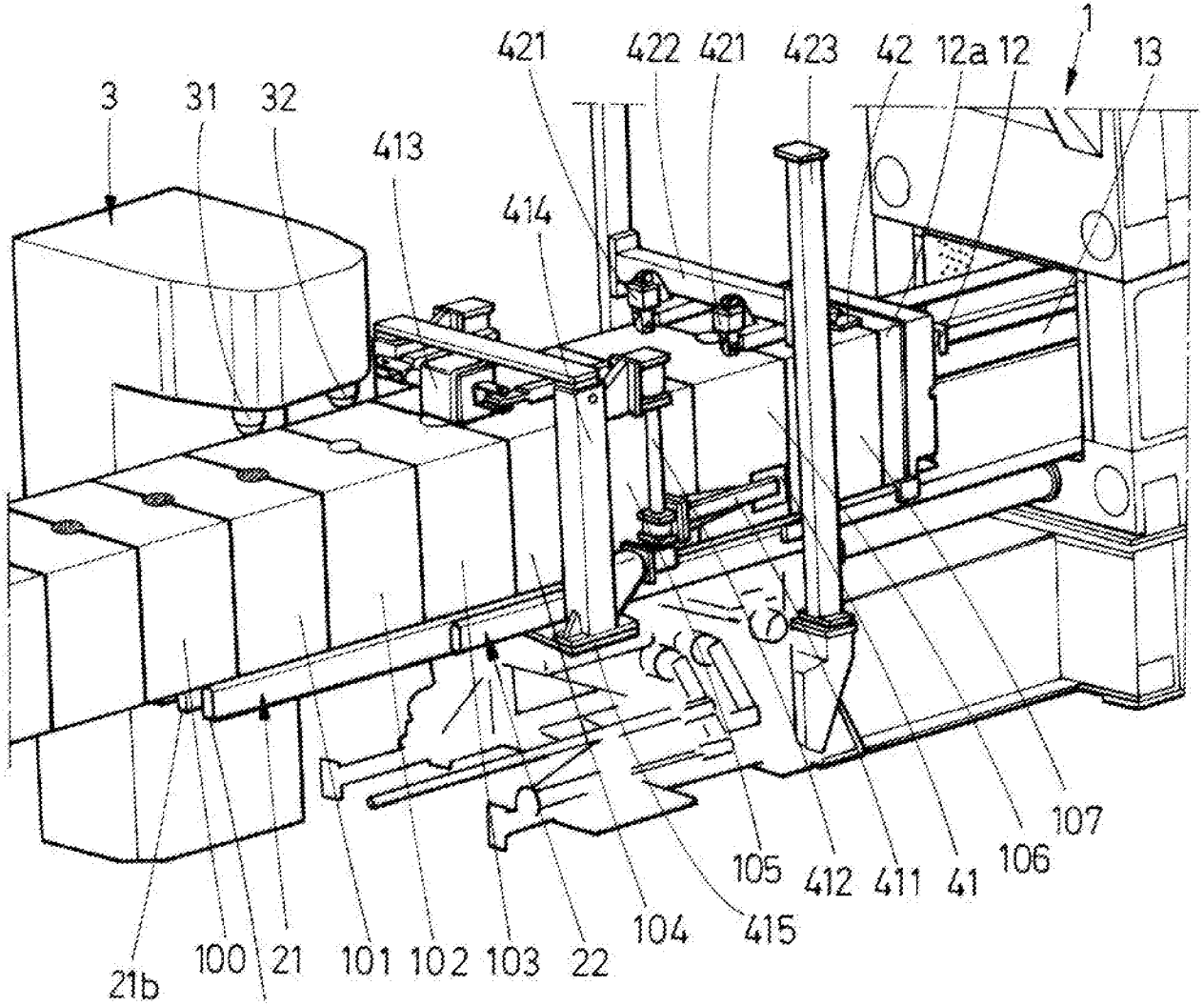

FIG. 4A illustrates a state of the system in which two moulds have just been filled, namely, the moulds between mould parts 100 and 101, and 101 and 102, respectively. The pouring at the pouring station has stopped. At this stage, a new mould part 107 is being pushed out of the mould making machine 1 and pushed until it arrives at the mould string, which includes previously produced mould parts 100-106. Now, the mould string is indexed one step, that is, the mould string is displaced a distance corresponding to the width of one mould part, so that a new mould arrives at the pouring station, namely, the mould defined by mould parts 102 and 103. This first indexing is achieved by displacing the first part 21 of the conveyor horizontally, a distance corresponding to one mould part width, in synchronization with the pushing movement of the rear plate 12. Here, the second retaining means may be activated so as to allow the rear plate 12 to be withdrawn and returned into the mould part making machine without displacing the new mould part 107 rearwards.

Figure 4C:
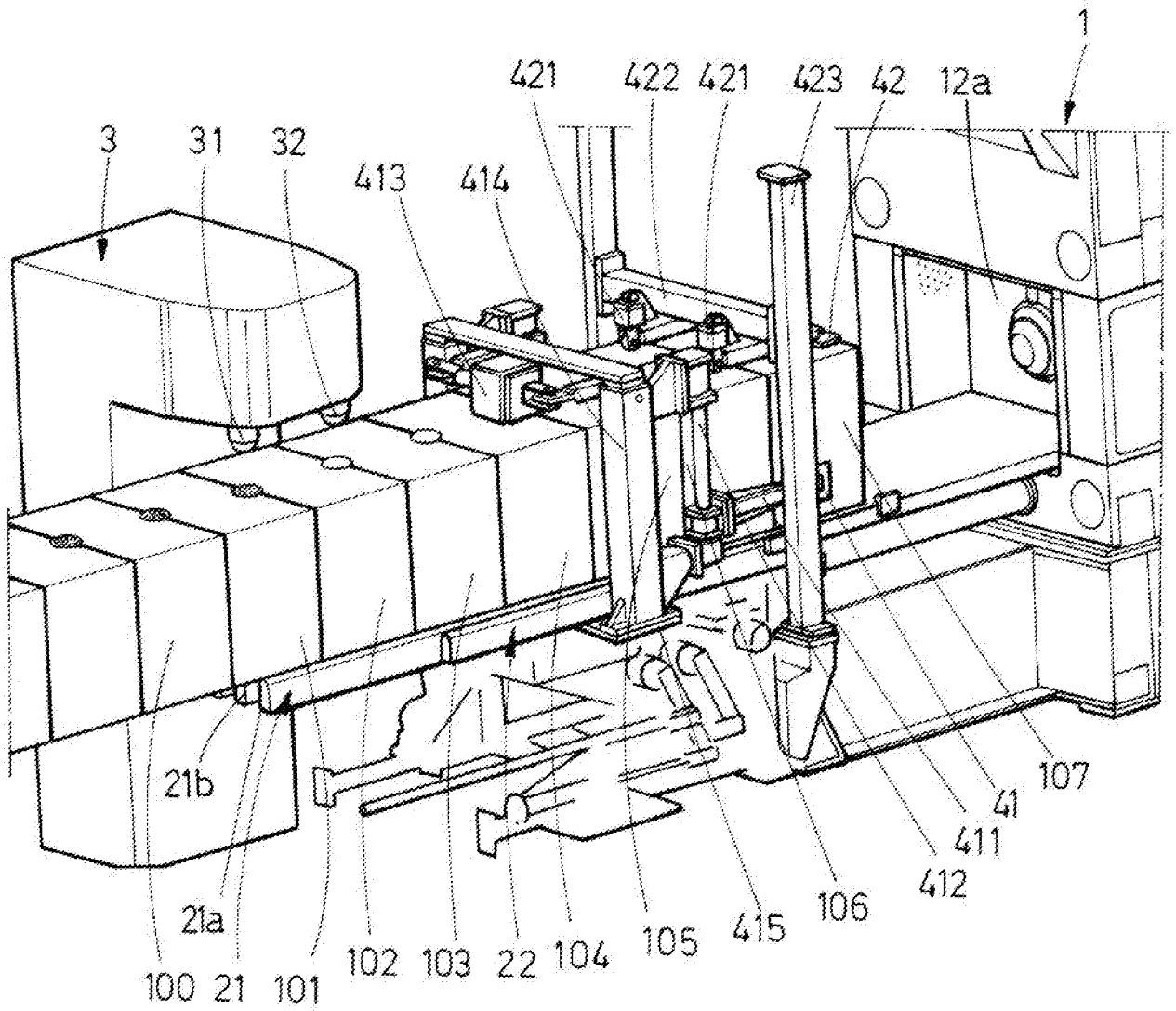
Figure 4D:
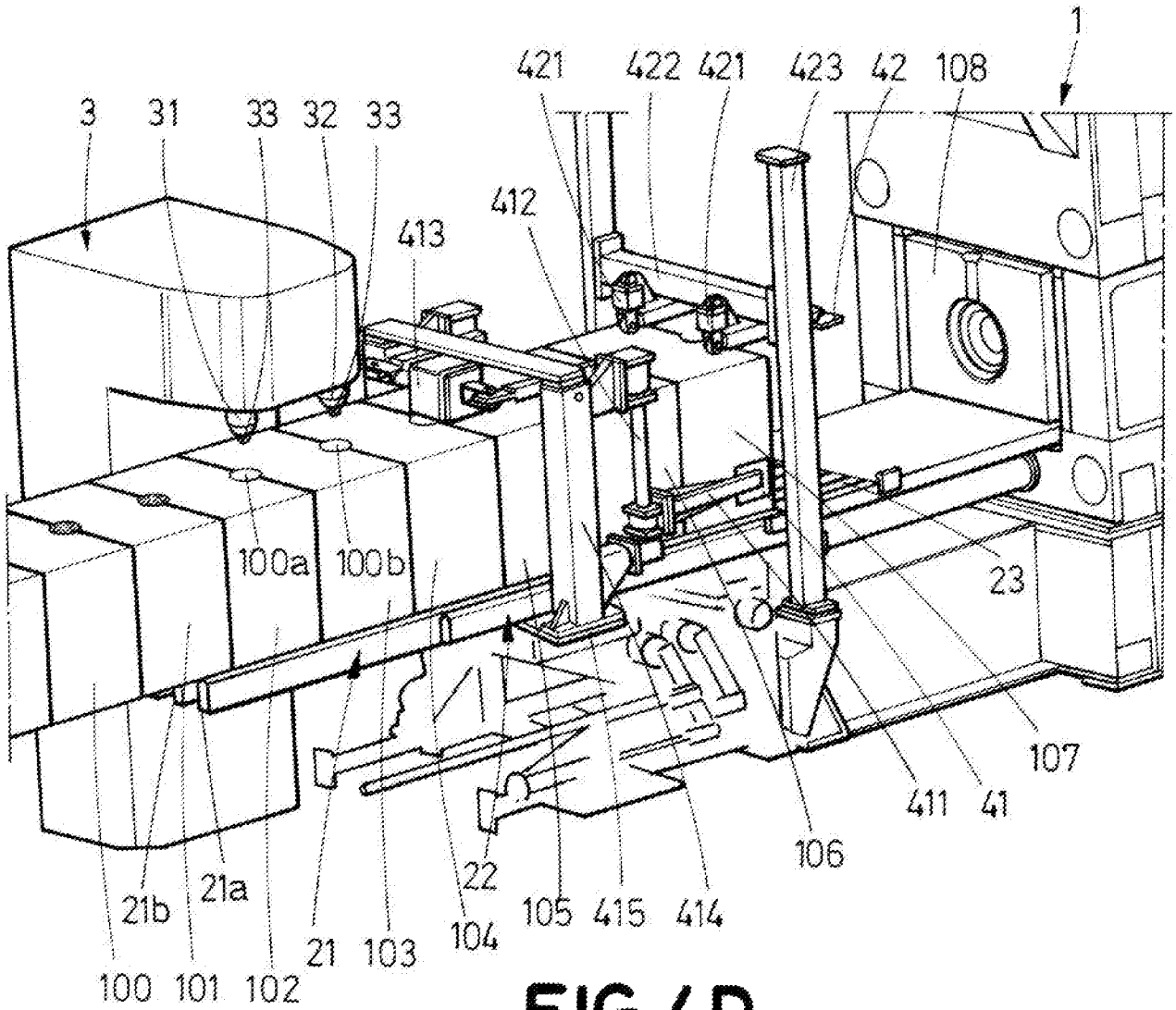
Figure 4E:
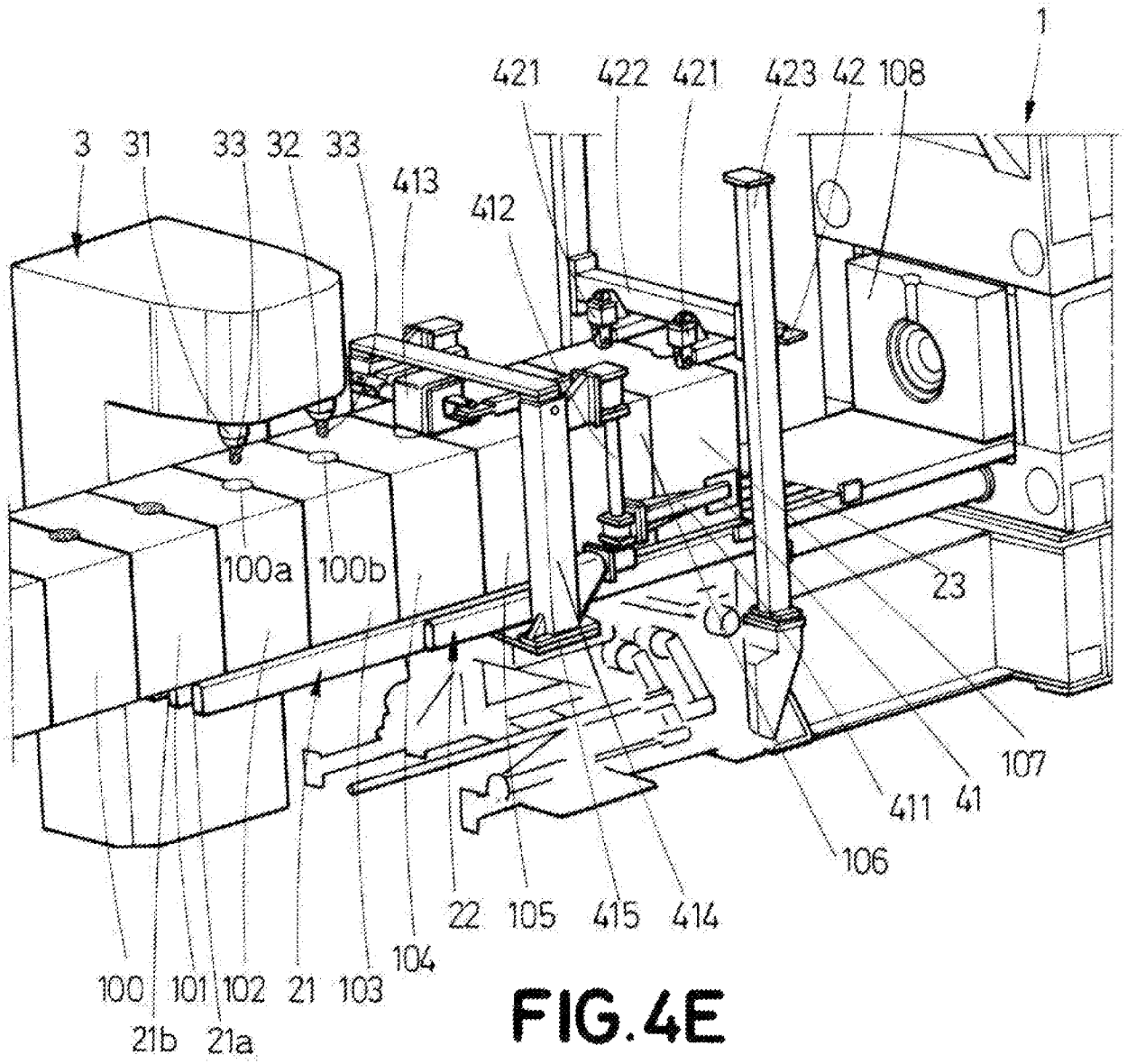
Figure 4F:
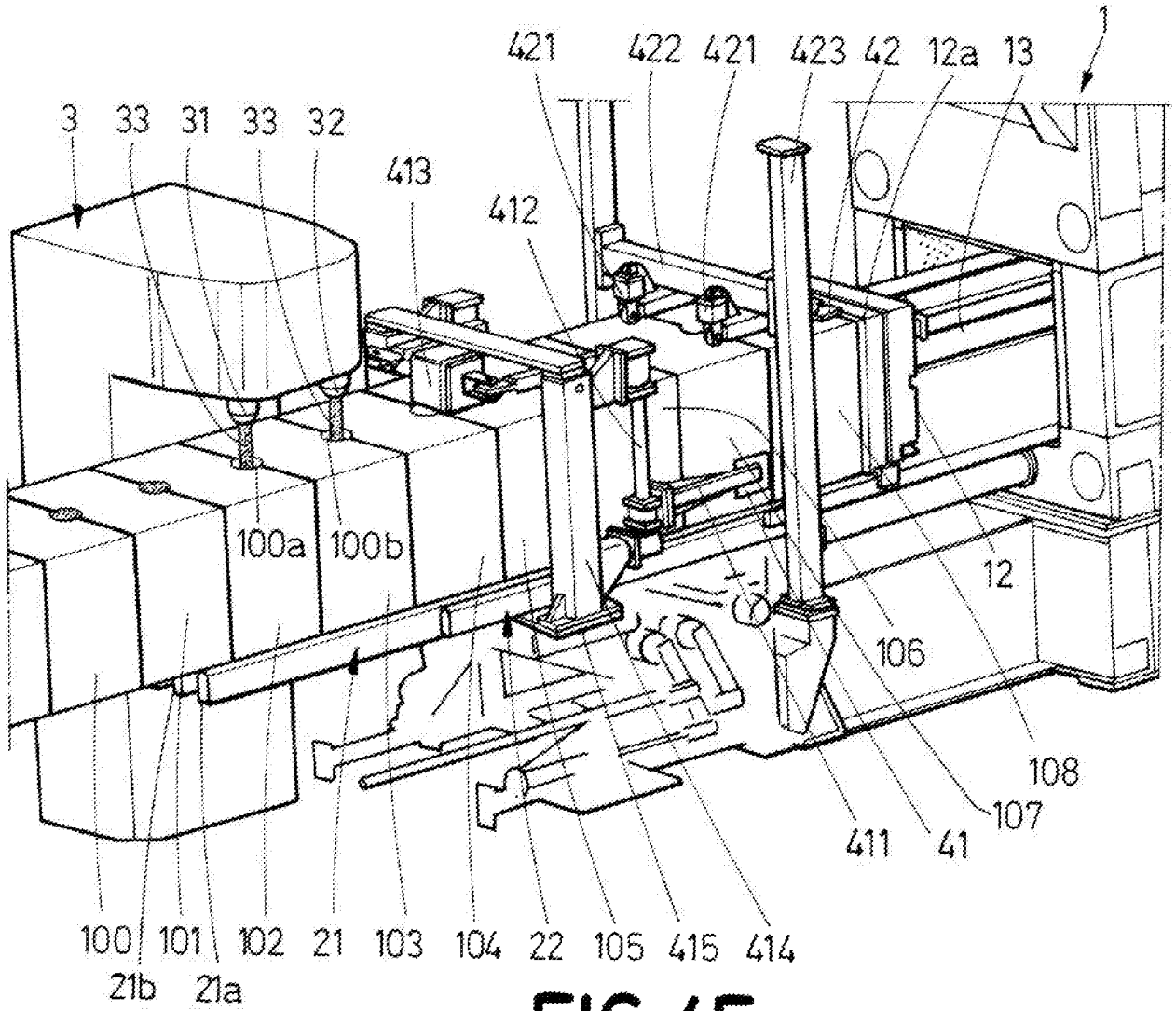

Next, the first part 21 of the conveyor returns towards the station 1 for making moulds, towards the position illustrated in FIG. 4C. Here, the second retaining means 42 can optionally continue to be activated and exerting pressure onto the top surface of the mould part 107. When the first part of the container arrives at its rearmost position, the first retaining means 41 are preferably activated to couple the mould string to the first part 21 of the conveyor, the second retaining means are deactivated to release the mould part 107, and the first part 21 of the conveyor is then indexed one step to towards the pouring station 3, thereby indexing the mould string so as to bring a new mould, the one defined by mould parts 103 and 104, into the pouring station. At this stage, as shown in FIG. 4D, compared to the situation in FIG. 4A, two new moulds have been brought into the pouring station and simultaneous pouring of molten metal 33 into the two moulds can now begin, as suggested in FIG. 4D. Thus, a difference when compared to the operation illustrated in FIGS. 3A-3F is that in the operation illustrated in FIGS. 4A-4F, the double indexing of the mould string is carried out in two steps, with a double stroke of the first part 21 of the conveyor, each stroke bringing the mould string one step forward, each step corresponding to the width of one mould part. In FIGS. 4E and 4F a new mould part 108 is produced by the mould making machine and pushed onto the third part 23 of the conveyor, and the second retaining means 43 are activated, applying pressure onto the top surface of the mould part 108 thus preventing it from being displaced backwards when the rear plate 12 is withdrawn into the moulding chamber to produce a further mould part.

This approach can be practical from a constructional point of view and it requires a comparatively short stroke in the horizontal direction by the first part 21 of the conveyor, as each stroke of said first part 21 of the conveyor only corresponds to the width of one mould part. However, a potential disadvantage compared to the way of operation illustrated in FIGS. 3A-3F resides in the fact that for a given mould part production rate, the time available for pouring is reduced, as pouring generally has to be interrupted during the time from that the first part of the conveyor 21 starts to move the mould string from the position shown in FIG. 4A and until the first part 21 of the conveyor has completed its second stroke forward, arriving at the state of the system illustrated in FIG. 4C. Thus, if it is desired to reduce as far as possible the time during which pouring has to be interrupted, in many cases the way of operation illustrated in FIGS. 3A-3F may be preferred over the way of operation illustrated in FIGS. 4A-4F.

On the other hand, whereas the embodiments described above correspond to a method and system for double indexing of the mould string, the invention also encompassed options such as triple indexing, quadruple indexing, etc. The same principles as those above can be applied, the only difference residing in the number of moulds that are produced between the subsequent shiftings of the mould string. For example, in the case of the method described in relation to FIGS. 4A-4F, triple indexing could imply repeating the stroke of the first part 21 three times while pouring is interrupted, and afterwards producing three new mould parts, the first one of which is pushed to make contact with the mould string when the second one comes out of the moulding chamber.

Also, whereas the invention has been disclosed in relation to specific types of conveyors, the invention can also be embodied with other types of conveyors, for example, with conveyors using horizontally moveable lateral squeeze plates to shift the mould string. In such embodiments, the first part of the conveyor may comprise said horizontally moveable lateral squeeze plates, and the second part of the conveyor can comprise a stationary surface on which the mould parts can be placed and slide when moved by the horizontally moveable lateral squeeze plates. Such squeeze plates can extend along a portion of the mould string comprising several mould parts, or even along the entirety of the mould string.

Obviously, the method and machine or system can include core setting by using core setters, for example, using prior art approaches such as those described in U.S. Pat. No. 7,806,161 or EP-B-1326726.

In this text, the term "comprises" and its derivations (such as "comprising", etc.) should not be understood in an excluding sense, that is, these terms should not be interpreted as excluding the possibility that what is described and defined may include further elements, steps, etc.

On the other hand, the invention is obviously not limited to the specific embodiments described herein, but also encompasses any variations that may be considered by any person skilled in the art (for example, as regards the choice of materials, dimensions, components, configuration, etc.), within the general scope of the invention as defined in the claims.

The invention claimed is:

1. Method for the stepwise production and advancing of sand mould parts in a mould-string foundry plant comprising a station for making mould parts, a pouring station and a conveyor for stepwise advancing of mould parts from said station for making mould parts towards said pouring station, said conveyor comprising a first part that is movable to displace mould parts from the station for making mould parts towards the pouring station, the method comprising producing a plurality of moulds parts in the station for making mould parts and placing said mould parts on the conveyor in order to form a mould string on the conveyor, and forwarding the mould parts towards the pouring station using the conveyor, the method comprising the steps of, repetitively and sequentially, (a) producing a first mould part of a pair of two subsequent mould parts;
(b) placing said mould part on the conveyor;
(c) producing a second mould part of said pair of two subsequent mould parts;
(d) placing also said second mould part on the conveyor;
(e) optionally producing at least one further mould part and placing said further mould part on the conveyor;
(f) displacing the mould string a distance corresponding to at least two mould part widths, so as to position at least two new moulds to be filled in correspondence with the pouring station, wherein step (f) is carried out by displacing said first part of the conveyor;

wherein step (f) is carried out without using any squeeze plate or rear plate of the station for making mould parts to push the mould string in-sync with movement of said first part of the conveyor for displacing the mould string said distance corresponding to at least two mould part widths.

2. Method according to claim 1, comprising the step of, after step (f), retaining the mould string using first retaining means to prevent mould parts from being displaced towards the station for making mould parts during pouring at the pouring station.

3. Method according to claim 2, wherein said first retaining means are arranged so as not to be horizontally displaced with said first part of the conveyor, and to interact with the mould string at a position between the pouring station and the station for making mould parts.

4. Method according to claim 2, wherein said first retaining means are arranged to be displaced together with said first part of the conveyor.

5. Method according to claim 2, wherein said first retaining means are arranged to retain the mould string by applying pressure to opposite lateral surfaces of a mould part.

6. Method according as in claim 2, comprising the step of retaining mould parts when delivered from the station for making mould parts, using second retaining means arranged to retain a mould part to prevent it from being pulled back towards the station for making mould parts, when a press plate used for delivering the mould part to the conveyor is returning towards the station for making mould parts.

7. Method according as in claim 1, wherein the conveyor comprises said first part and a second part, both of said first part and second part being moveable in the vertical direction between an upper position in which the mould parts are in contact with the corresponding part of the conveyor so that said part of the conveyor supports the mould parts, and a lower position in which the mould parts are not supported by the respective part of the conveyor.

8. Method according to claim 7, wherein said first part and second part are coordinated so that while the method is carried out, at least one of said first part and second part are in the upper position, so as to maintain the mould string at a constant height.

9. Method according to claim 7, wherein said second part is in the lower position while said first part is being displaced in step (f).

10. Method for the stepwise production and advancing of sand mould parts in a mould-string foundry plant comprising a station for making mould parts, a pouring station and a conveyor for stepwise advancing of mould parts from said station for making mould parts towards said pouring station, said conveyor comprising a first part that is movable to displace mould parts from the station for making mould parts towards the pouring station, the method comprising producing a plurality of mould parts in the station for making mould parts and placing said mould parts on the conveyor in order to form a mould string on the conveyor, and forwarding the mould parts towards the pouring station using the conveyor, the method comprising the steps of, repetitively and sequentially, (a) producing a first mould part of a pair of two subsequent mould parts;

(b) placing said mould part on the conveyor;

(c) producing a second mould part of said pair of two subsequent mould parts;

(d) placing also said second mould part on the conveyor;

(e) optionally producing at least one further mould part and placing said further mould part on the conveyor;

(f) displacing the mould string a distance corresponding to at least two mould part widths, so as to position at least two new moulds to be filled in correspondence with the pouring station, wherein step (f) is carried out by displacing said first part of the conveyor;

wherein the station for making mould parts includes a mould part making apparatus comprising a moulding chamber in which mould parts are made by pressing sand between a front plate and a rear plate, said rear plate being horizontally displaceable with a stroke so as to push a finished mould part out of the moulding chamber and onto the conveyor, wherein during steps (a)-(e), the rear plate is repetitively displaced with the same stroke.

11. Method according to claim 10, comprising the step of, after step (f), retaining the mould string using first retaining means to prevent mould parts from being displaced towards the station for making mould parts during pouring at the pouring station.

12. Method according to claim 11, wherein said first retaining means are arranged so as not to be horizontally displaced with said first part of the conveyor, and to interact with the mould string at a position between the pouring station and the station for making mould parts.

13. Method according to claim 11, wherein said first retaining means are arranged to be displaced together with said first part of the conveyor.

14. Method according to claim 11, wherein said first retaining means are arranged to retain the mould string by applying pressure to opposite lateral surfaces of a mould part.

15. Method according as claim 11, comprising the step of retaining mould parts when delivered from the station for making mould parts, using second retaining means arranged to retain a mould part to prevent it from being pulled back towards the station for making mould parts, when a press plate used for delivering the mould part to the conveyor is returning towards the station for making mould parts.

16. Method according as in claim 10, wherein the conveyor comprises said first part and a second part, both of said first part and second part being moveable in the vertical direction between an upper position in which the mould parts are in contact with the corresponding part of the conveyor so that said part of the conveyor supports the mould parts, and a lower position in which the mould parts are not supported by the respective part of the conveyor.

17. Method according to claim 16, wherein said first part and second part are coordinated so that while the method is carried out, at least one of said first part and second part are in the upper position, so as to maintain the mould string at a constant height.

18. Method according to claim 16, wherein said second part is in the lower position while said first part is being displaced in step (f).

19. Method for the stepwise production and advancing of mould parts in a mould-string foundry plant, said plant comprising a station for making mould parts, a pouring station and a conveyor for stepwise advancing of mould parts from said station for making mould parts towards said pouring station, said conveyor comprising a first part that is movable to displace mould parts towards the pouring station, the method comprising producing a plurality of mould parts in the station for making mould parts, and placing said mould parts on the conveyor in order to form a mould string on the conveyor, and forwarding the mould parts towards the pouring station using the conveyor, said conveyor further being associated with first retaining means and second retaining means, wherein the method includes the steps of, repetitively and sequentially, (i)- producing a mould part, (ii)- placing said mould part on the conveyor in contact with a preceding mould part of a string of moulds parts, (iii)- displacing the string of mould parts a distance corresponding to one mould part width so as to position a first new mould to be filled in correspondence with the pouring station, by displacing the first part of the conveyor in a horizontal direction towards said pouring station, and optionally pushing the mould string with a rear plate of the station for making mould parts;

(iv)- returning said first part of the conveyor towards the station for making mould parts a distance corresponding to one mould part width, while optionally retaining the mould string using said second retaining means;

(v)- once again displacing the string of mould parts a distance corresponding to one mould part width so as to position a second new mould to be filled in correspondence with the pouring station, by once again displacing the first part of the conveyor in said horizontal direction towards said pouring station;

(vi)- optionally, repeating steps (iv) and (v);

(vii)- retaining the mould string using said first retaining means or said second retaining means so as to prevent mould parts from being displaced towards the station for making mould parts during pouring into the moulds, and beginning pouring into at least two moulds at the pouring station;

(viii)- producing at least one mould part and placing said mould part on the conveyor in contact with the mould part produced in step (i), and optionally retaining said mould part produced in step (viii) by using said second retaining means.

* * * * *